US009234688B2

(12) United States Patent
Son et al.

(10) Patent No.: US 9,234,688 B2
(45) Date of Patent: Jan. 12, 2016

(54) ICE MAKER

(75) Inventors: Juhyun Son, Gyeongsangnam-do (KR); Wookyong Lee, Gyeongsangnam-do (KR); Donghoon Lee, Gyeongsangnam-do (KR); Dongjeong Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 636 days.

(21) Appl. No.: 13/548,688

(22) Filed: Jul. 13, 2012

(65) Prior Publication Data

US 2013/0014536 A1 Jan. 17, 2013

(30) Foreign Application Priority Data

Jul. 15, 2011 (KR) ..... 10-2011-0070358

(51) Int. Cl.

| | |
|---|---|
| ***F25C 1/00*** | (2006.01) |
| ***F25C 1/10*** | (2006.01) |
| ***F25C 1/04*** | (2006.01) |
| ***F25C 1/22*** | (2006.01) |
| ***F25C 5/06*** | (2006.01) |
| *F25C 5/00* | (2006.01) |
| *F25C 5/04* | (2006.01) |

(52) U.S. Cl.

CPC ... *F25C 1/04* (2013.01); *F25C 1/22* (2013.01); *F25C 1/225* (2013.01); *F25C 5/06* (2013.01); *F25C 5/005* (2013.01); *F25C 5/04* (2013.01)

(58) Field of Classification Search

CPC ..... F25C 2305/022; F25C 1/00; F25C 1/10; F25C 1/22; F25C 1/225; F25C 1/24; F25C 1/243

See application file for complete search history.

(56) References Cited

U.S. PATENT DOCUMENTS

| | | | | |
|---|---|---|---|---|
| 4,910,974 | A * | 3/1990 | Hara | 62/347 |
| 6,857,277 | B2 * | 2/2005 | Somura | 62/74 |
| 2005/0151049 | A1 | 7/2005 | Lion | |
| 2006/0254285 | A1 | 11/2006 | Lin | |
| 2007/0107447 | A1 * | 5/2007 | Langlotz | 62/66 |

(Continued)

FOREIGN PATENT DOCUMENTS

| | | | |
|---|---|---|---|
| EP | 0 326 144 | A2 | 8/1989 |
| FR | 2437590 | A1 | 4/1980 |
| JP | 2005-326035 | A | 11/2005 |
| KR | 10-2011-0037609 | A | 4/2011 |

OTHER PUBLICATIONS

Chinese Office Action dated Apr. 1, 2014 for Application No. 201210245838.8 with English Translation, 7 Pages.

(Continued)

*Primary Examiner* — Frantz Jules
*Assistant Examiner* — Erik Mendoza-Wilkenfel
(74) *Attorney, Agent, or Firm* — Fish & Richardson P.C.

(57) ABSTRACT

Provided is an ice maker. The ice maker includes an upper tray including a plurality of first recessed parts, each having a hemispherical shape, and a lower tray including a plurality of second recessed parts, each having a hemispherical shape. The ice maker also includes a driving unit that moves at least one of the upper tray and the lower tray to change between an attached orientation in which the upper tray is attached to the lower tray to define a plurality of spherical shells and a separated orientation in which the upper tray is separated from the lower tray. The ice maker further includes a water supply part configured to supply water into the shells and an ejecting unit disposed outside the shells and configured to facilitate separation of ice pieces made in the shells.

7 Claims, 19 Drawing Sheets

(56) References Cited

U.S. PATENT DOCUMENTS

| | | | | |
|---|---|---|---|---|
| 2007/0283714 | A1 | 12/2007 | Yoon | |
| 2009/0145159 | A1 | 6/2009 | Kim | |
| 2010/0319367 | A1* | 12/2010 | Kim et al. | 62/71 |

OTHER PUBLICATIONS

European Search Report dated Jul. 20, 2015 for European Application No. 12005167, 7 pages.

* cited by examiner

ICE MAKER

CROSS-REFERENCE TO RELATED APPLICATIONS

The present application claims priority under 35 U.S.C. 119 and 35 U.S.C. 365 to Korean Patent Application No. 10-2011-0070358 (filed on Jul. 15, 2011), which is hereby incorporated by reference in its entirety.

FIELD

This disclosure relates to an ice maker.

BACKGROUND

In general, refrigerators are home appliances for storing foods at a low temperature in an inner storage space covered by a door. That is, since such a refrigerator cools the inside of the storage space using cool air generated by heat-exchanging with a refrigerant circulating a refrigeration cycle, foods stored in the storage space may be stored in a refrigerated or frozen state.

Also, an ice maker for making ice may be provided inside the refrigerator. The ice maker is configured so that water supplied from a water supply source or a water tank is received into an ice tray to make ice. Also, the ice maker is configured to separate the made ice from the ice tray by heating or twisting the ice tray.

As described above, the ice maker in which water is automatically supplied and ices are automatically separated may have a structure which is opened upward to lift the made ice up. Also, each of ices made in the ice maker having the above-described structure may have a shape having at least one flat surface, such as a crescent moon shape or a cubic shape.

SUMMARY

In one aspect, an ice maker includes an upper tray having a plurality of first recessed parts and a lower tray having a plurality of second recessed parts. Each of the first recessed parts has a hemispherical shape and each of the second recessed parts has a hemispherical shape. The ice maker also includes a driving unit that is connected to at least one of the upper tray and the lower tray and that is configured to move at least one of the upper tray and the lower tray to change between an attached orientation in which the first recessed parts of the upper tray are attached to the second recessed parts of the lower tray to define a plurality of spherical shells and a separated orientation in which the first recessed parts of the upper tray are separated from the second recessed parts of the lower tray. The ice maker further includes a water supply part configured to supply water into the shells defined in the attached orientation and an ejecting unit that is disposed outside of the shells and that is configured to facilitate separation of ice pieces made in the shells from at least one of the upper tray and the lower tray.

Implementations may include one or more of the following features. For example, a top surface of at least one of the first recessed parts may have an air hole configured to exhaust air existing within the shells during supply of water to the shells. In this example, a top surface of at least one of the first recessed parts may have a water hole that is different from the air hole, and an outlet end of the water supply part may be disposed adjacent to the water hole and configured to supply water into the shells through the water hole.

In some implementations, the ice maker may include a water path configured to guide water flow between the shells adjacent to each other. In these implementations, the water path may include an upper path defined in the first recessed parts and a lower path defined in the second recessed parts. The upper path and the lower path may contact and communicate with each other in the attached orientation.

In some examples, the ejecting unit may include at least one ice separation heater mounted on at least one of the upper tray and the lower tray. In these examples, the ejecting unit also may include at least one of an upper ejecting pin that passes through a hole defined in a top surface of at least one of the first recessed parts, and a lower ejecting pin configured to press at least one of the second recessed parts in the separated orientation.

In some implementations, the ejecting unit may include at least one of an upper ejecting pin that passes through a hole defined in a top surface of at least one of the first recessed parts, and a lower ejecting pin configured to press at least one of the second recessed parts in the separated orientation. In these implementations, the driving unit may include an upper plate gear connected to a rotation shaft of the upper tray, a lower plate gear connected to a rotation shaft of the lower tray, and a motor configured to drive the upper plate gear and the lower plate gear to rotate the upper tray and the lower tray between the attached orientation and the separated orientation. The lower plate gear may be engaged and rotated with the upper plate gear. The lower plate gear may have a diameter less than that of the upper plate gear.

In some examples, the ice maker may include a rotating arm having a first end connected to a rotation shaft of the lower tray and an elastic member having a first end connected to a second end of the rotating arm and a second end connected to the lower tray. In these examples, the elastic member may provide an elastic force to secure the lower tray and the upper tray in the attached orientation, and the driving unit may include a motor connected to the rotation shaft of the lower tray.

Further, the ejecting unit may include an upper ejecting pin that passes through a hole defined in a top surface of at least one of the first recessed parts and a link having a first end connected to the upper ejecting pin and a second end connected to the rotating arm or the lower tray. In addition, the ejecting unit may include at least one of an ice separation heater mounted on an outer surface of at least one of the upper tray and the lower tray, and a lower ejecting pin configured to press at least one of the second recessed parts in the separated orientation.

In some implementations, the lower tray may include a tray case coupled to the driving unit, the tray case having a plurality of holes successively arranged therein, a tray body seated on the tray case, the tray body having the plurality of second recessed parts, and a tray cover seated on the tray body, the tray cover fixing the tray body to the tray case. In these implementations, the ice maker may include at least one lower protrusion that protrudes along an edge of an open surface of each of the second recessed parts and at least one upper protrusion that protrudes along an edge of an open surface of each of the first recessed parts. In the attached orientation, the at least one lower protrusion may attach to an inner surface of the at least one upper protrusion.

The ice maker also may include a gasket disposed between contact portions of the upper tray and the lower tray. In addition, at least a portion of at least one of the second recessed parts may be made of a deformable flexible material.

In another aspect, an ice maker includes a case, an upper tray received in the case, and a lower tray. The upper tray has a plurality of first recessed parts and the lower tray has a plurality of second recessed parts. Each of the first recessed parts has a hemispherical shape and each of the second recessed parts has a hemispherical shape. The ice maker also includes a water supply part configured to supply water into spherical shells defined based on the first recessed parts of the upper tray being attached to the second recessed parts of the lower tray. The ice maker further includes an ejecting unit configured to provide power that separates the upper tray and the lower tray from each other and a power transmission unit that connects the driving unit to the upper tray and the lower tray. The power transmission unit is configured to separate the upper tray and the lower tray from each other.

Implementations may include one or more of the following features. For example, the driving unit may include a motor mounted on a side surface of the case, and the power transmission unit may include a pinion connected to a rotation shaft of the motor and a rack member attached to the upper tray and the lower tray. In this example, the rack member may be engaged with the pinion.

In some implementations, the rack member may include an upper rack attached to the upper tray and a lower rack attached to the lower tray. In these implementations, the upper rack and the lower rack each may be connected to the pinion and, from a position in which the upper rack faces the lower rack with respect to the pinion, the upper rack may extend in a direction opposite of the lower rack.

In some examples, the ice maker may include a first guide groove having a predetermined curvature and extending in an arc shape in the upper rack and a second guide groove having a predetermined curvature and extending in an arc shape in the lower rack. In these examples, the ice maker may include a plurality of guide protrusions that protrude from a side surface of the case. At least one of the plurality of guide protrusions may be fitted into the first guide groove to guide rotation of the upper rack and at least one of the plurality of guide protrusions may be fitted into the second guide groove to guide rotation of the lower rack.

In some implementations, the plurality of guide protrusions may be spaced apart from each other with respect to a rotation center of the motor and arranged parallely at positions facing each other. In these implementations, the guide protrusions may separate from the first guide groove and the second guide groove at about a ninety degree rotation of each of the upper rack and the lower rack. At least one of the guide protrusions that is disposed opposite of the at least one of the guide protrusions that guides rotation of the upper rack may be configured to stop rotation of the upper rack. In addition, at least one of the guide protrusions that is disposed opposite of the at least one of the guide protrusions that guides rotation of the lower rack may be configured to stop rotation of the lower rack.

After rotation of the upper rack is stopped and rotation of the lower rack is stopped, rotation of the pinion may cause linear movement of the upper rack and the lower rack in opposite directions to separate the upper and lower trays from each other. Further, the ejecting unit may include a first ejecting pin configured to push ice pieces attached to the upper tray and a second ejecting pin configured to push ice pieces attached to the lower tray.

The details of one or more implementations are set forth in the accompanying drawings and the description below. Other features will be apparent from the description and drawings, and from the claims.

DETAILED DESCRIPTION

Figure 1:
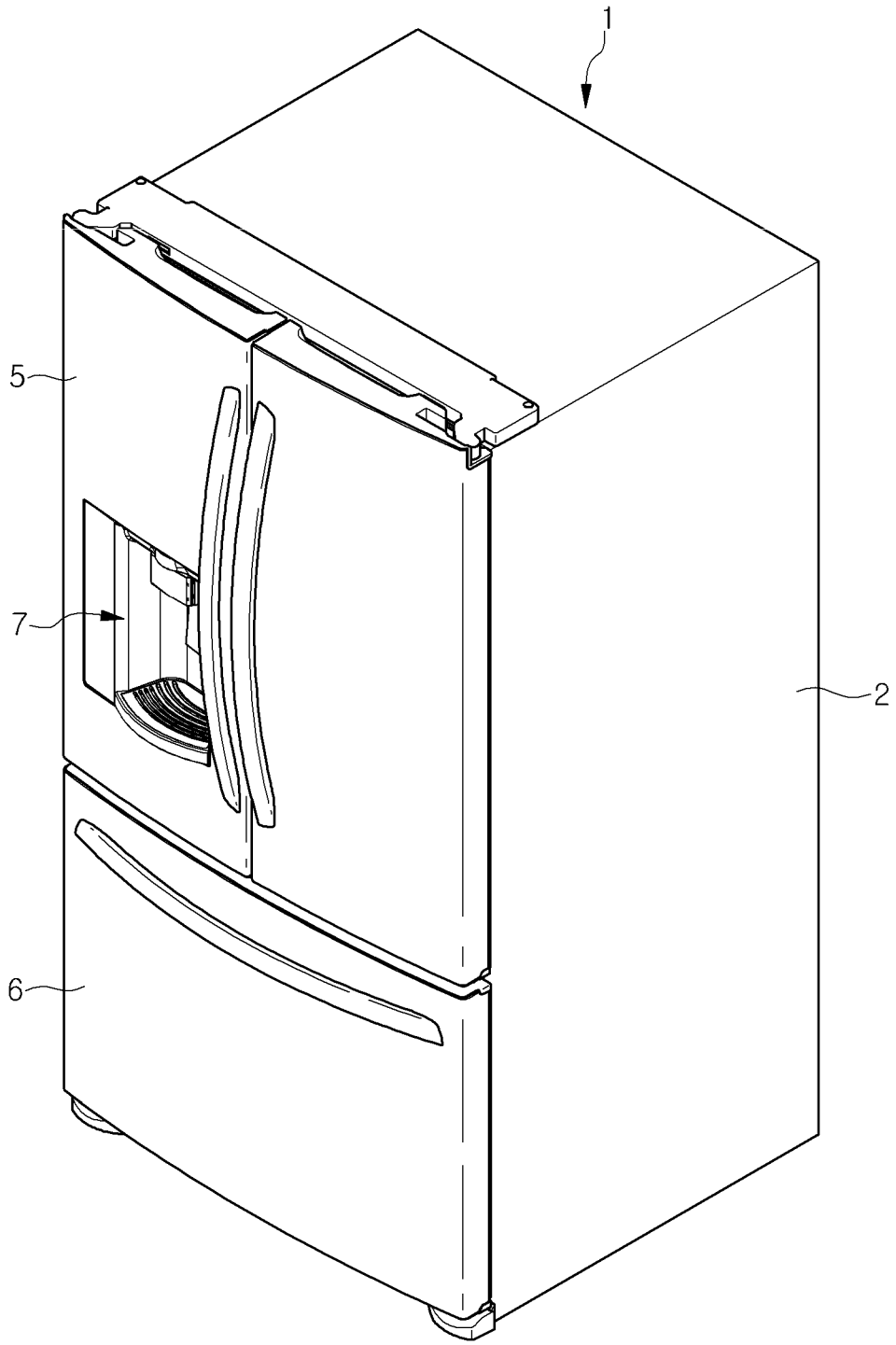
FIG. 1 is a perspective view of a refrigerator.
Figure 2:
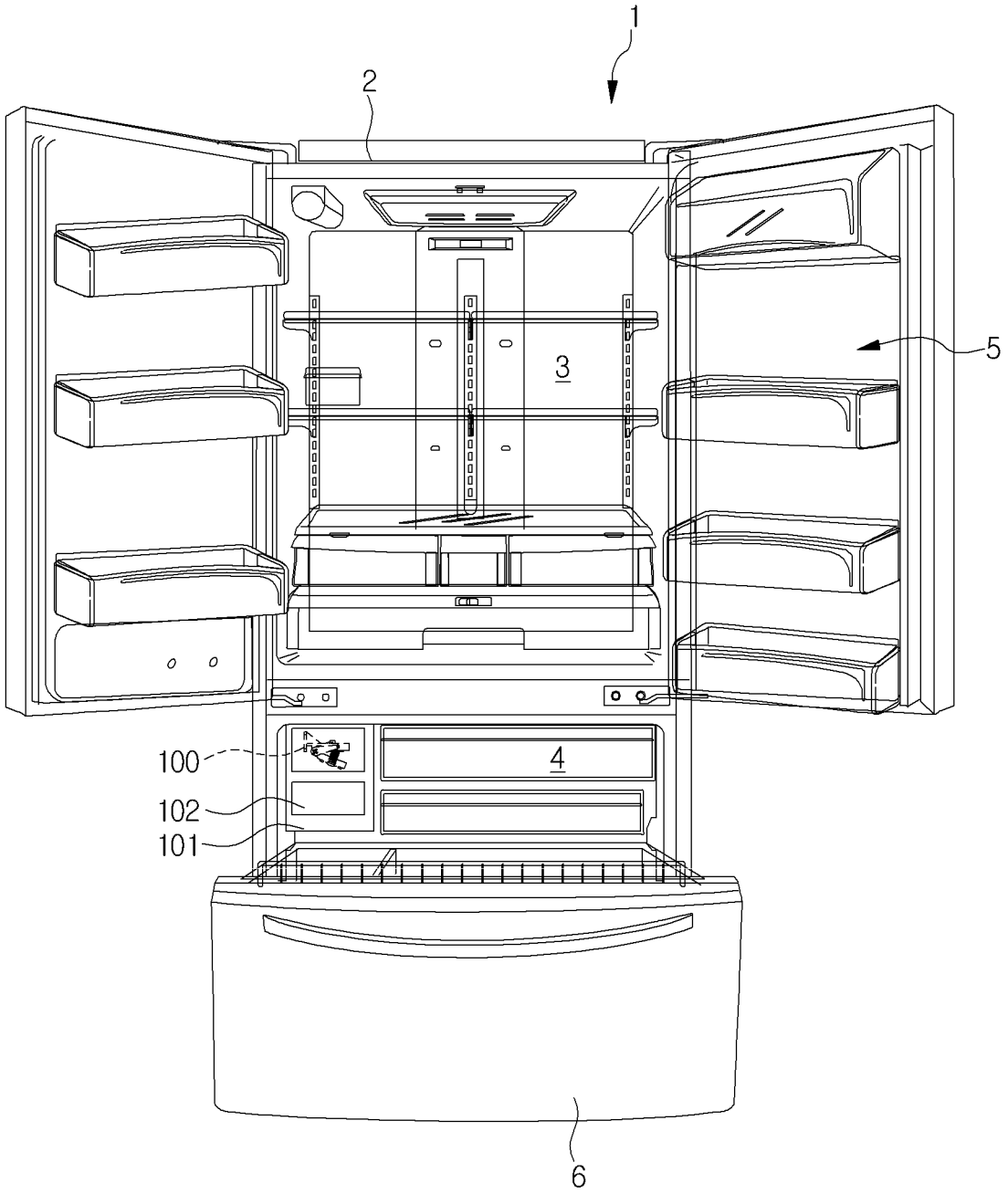
FIG. 2 is a view of the refrigerator in a state where a door is opened.

FIG. 1 illustrates an example refrigerator. FIG. 2 illustrates the example refrigerator in a state where a door is opened.

Referring to FIGS. 1 and 2, a refrigerator 1 includes a cabinet 2 defining a storage space and doors for opening or closing the storage space. Here, an outer appearance of the refrigerator 1 may be defined by the cabinet 2 and the doors. Hereinafter, among various types of refrigerators, a bottom freezer-type refrigerator in which a freezing compartment is disposed under a refrigerating compartment and the refrigerating compartment is covered by a pair of rotatable doors (e.g., french doors) will be described as an example. However, the ice makers described throughout this disclosure are not limited to the bottom freezer-type refrigerator. For example, the ice makers described throughout this disclosure may be applied to various types of refrigerators.

In detail, the cabinet 2 has a storage space vertically partitioned by a barrier. That is, a refrigerating compartment 3 is defined at an upper side, and a freezing compartment 4 is defined at a lower side. Receiving members, such as a drawer, a shelf, a basket, and the like, may be provided within the refrigerating compartment 3 and the freezing compartment 4.

The doors include a refrigerating compartment door 5 for covering the refrigerating compartment 3 and a freezing compartment door 6 for covering the freezing compartment 4. The refrigerating compartment door 5 may be constituted by a pair of left and right doors. Thus, the pair of doors may be rotated to selectively open or close the refrigerating compartment 3. Also, the freezing compartment door 6 may be withdrawably provided in a drawer type configuration.

A dispenser 7 for dispensing purified water and/or made ice pieces to the outside may be disposed in the refrigerating compartment door 5. The dispenser 7 may communicate with an ice maker 100 (that will be described below) or a part for storing ice made in the ice maker 100 to dispense the made ice to the outside through the dispenser 7.

The ice maker 100 is provided in the freezing compartment 4. The ice maker 100 may make ice pieces using supplied water. Also, the ice maker 100 may make ice pieces having a globular or spherical shape. An ice bank 102 in which made ice pieces are separated from the ice maker 100 and then stored may be further disposed under the ice maker 100. The ice maker 100 and the ice bank 102 may be mounted inside the freezing compartment 4 in a state where the ice maker 100 and the ice bank 102 are received in a separate case 101.

Figure 3:
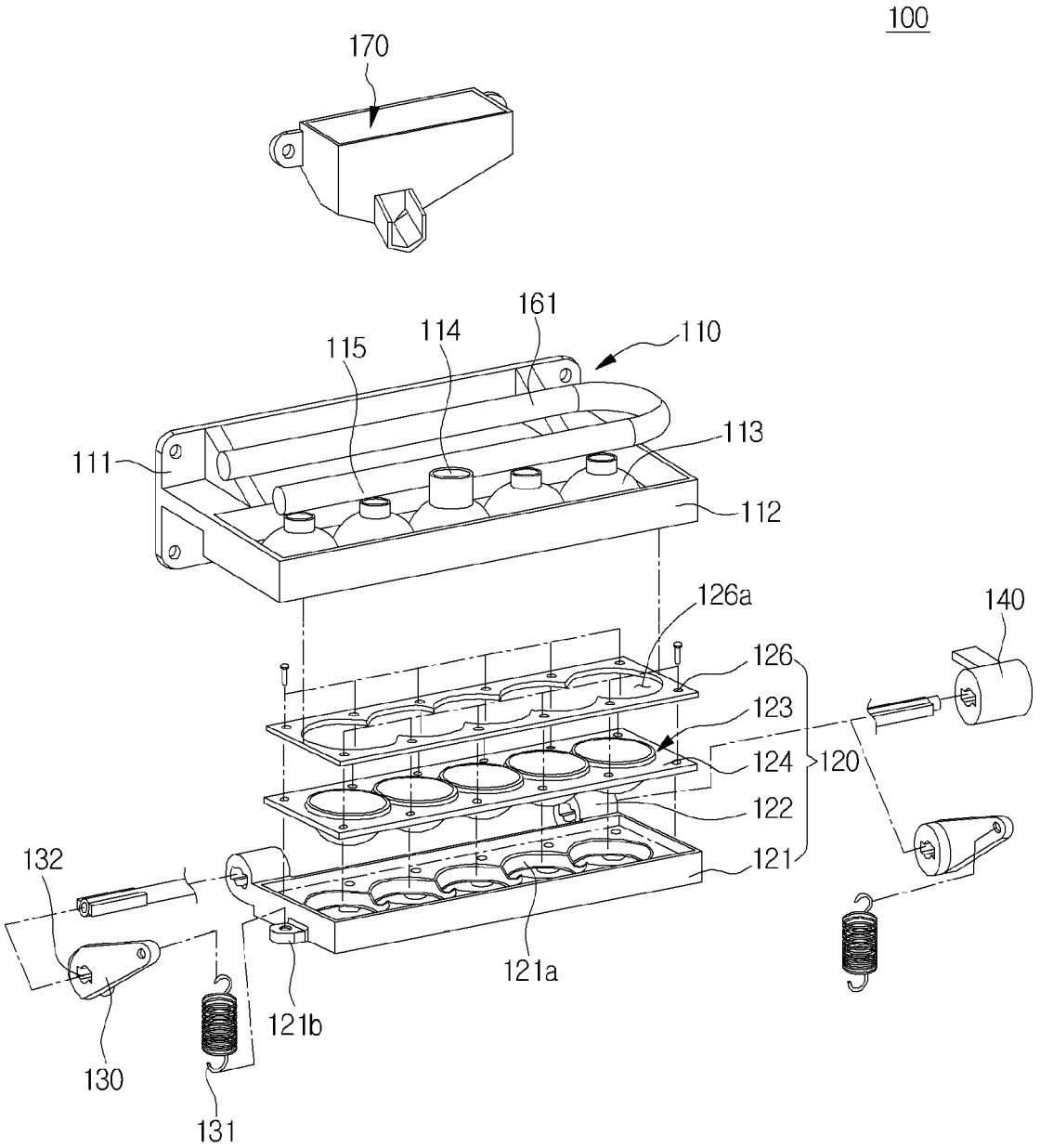
FIG. 3 is an exploded perspective view of an ice maker.
Figure 4:
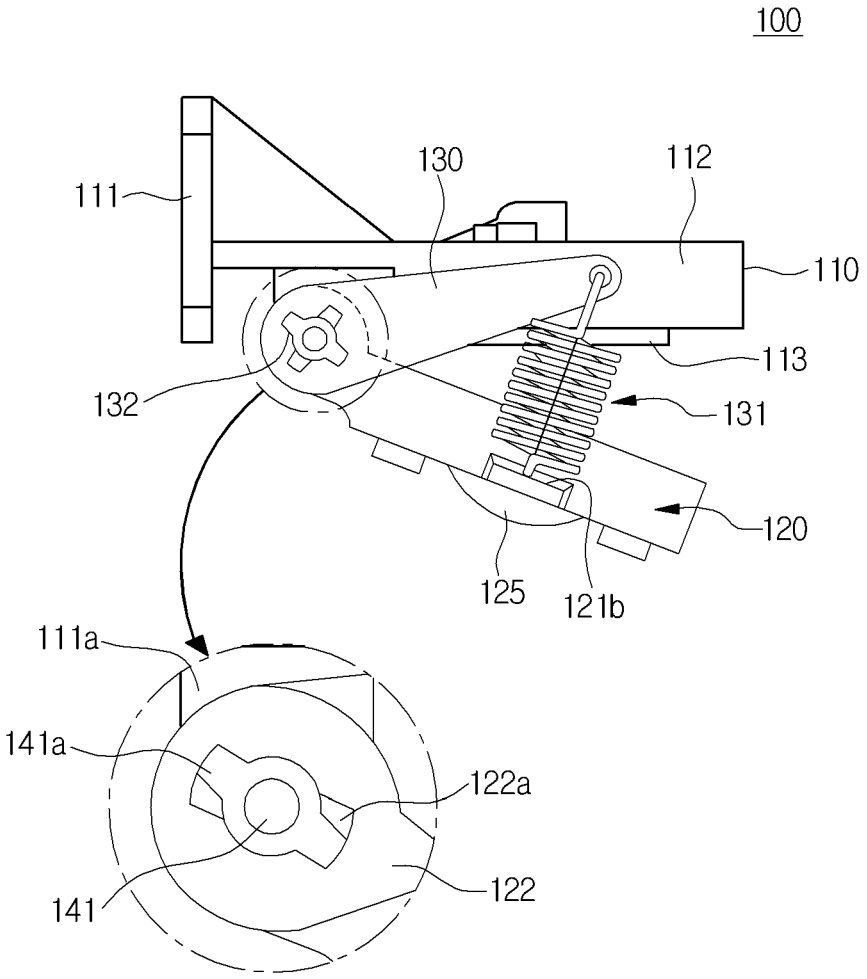
FIG. 4 is a side view of a state in which the ice maker is opened.
Figure 5:
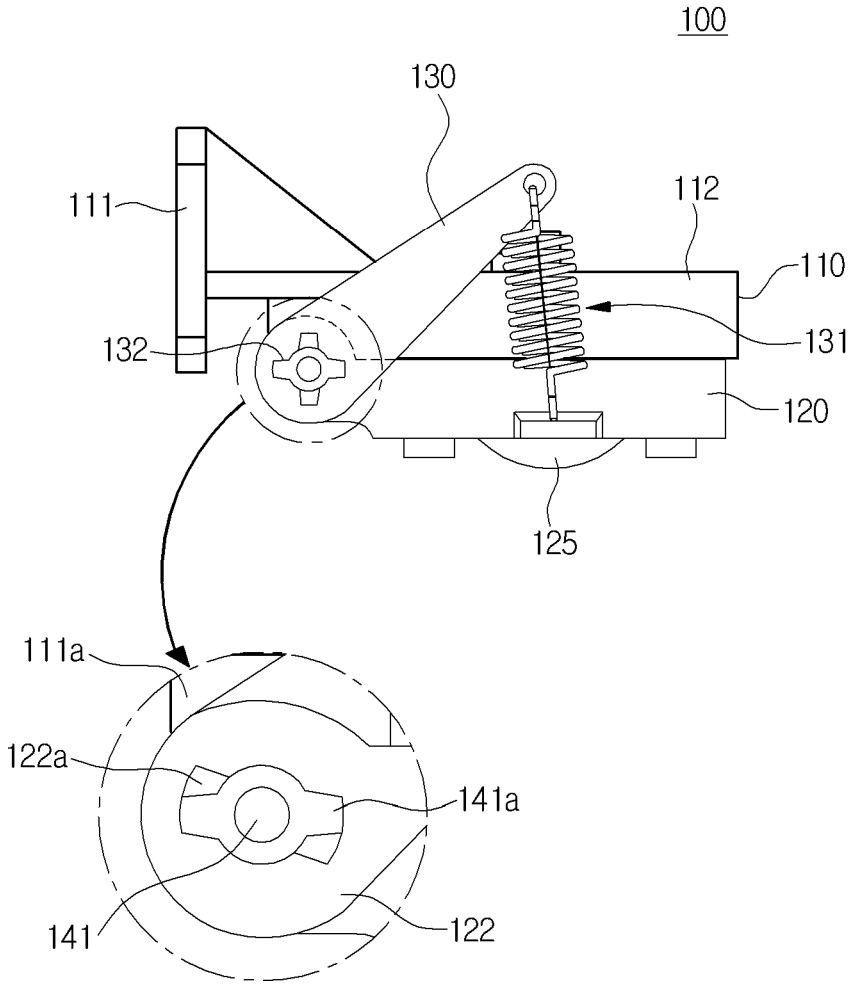
FIG. 5 is a side view of a state in which the ice maker is closed.

FIG. 3 illustrates an example of the ice maker 100 in an exploded format. FIG. 4 is a side view of a state in which the ice maker is opened. FIG. 5 is a side view of a state in which the ice maker is closed.

Referring to FIGS. 3 to 5, the ice maker 100 includes an upper tray 110 defining an upper appearance, a lower tray 120 defining a lower appearance, a driving unit 140 for operating one of the upper tray 110 and the lower tray 120, and an ejecting unit 160 (see FIG. 11) for separating made ice pieces in the upper tray 110 or the lower tray 120.

In more detail, the lower tray 120 has an approximately square shape. Also, the lower tray 120 has a recessed part 125 having a hemispherical shape so that a portion less than half of the globular ice piece is made. The lower tray 120 may be formed of a metal material. As necessary, at least one portion of the lower tray 120 may be formed of an elastically deformable material. In some implementations, the lower tray 120 has a portion thereof formed of an elastic material so that the lower tray 120 is deformed by the ejecting unit 160 to perform an ice separation process.

The lower tray 120 may include a tray case 121 defining an outer appearance, a tray body 123 mounted on the tray case 121 to form the recessed part 125 that is a space for making an ice piece, and a tray cover 126 for fixing and mounting the tray body 123 to the tray case 121.

The tray case 121 may have a square frame shape. Also, the tray case 121 may further extend upward and downward along a circumference thereof. Also, a seat part 121*a* punched in a circular shape is disposed within the tray case 121. The seat part 121*a* may have a shape corresponding to that of the recessed part 125 of the tray body 123. Also, the seat part 121*a* has a rounded inner side surface so that the recessed part 125 having the hemispherical shape is stably inserted therein. The seat part 121*a* may be provided in plurality to correspond to the position and shape of the recessed part 125. Thus, the plurality of seat parts 121*a* may be successively arranged in a line and connected to each other.

Also, a lower tray connection part 122 is disposed on a rear side of the tray case 121. The lower tray connection part 122 is coupled to the upper tray 110 and the driving unit 140 so that the tray case 121 is rotatably mounted on the upper tray 110.

Also, an elastic member 131 for providing an elastic force to maintain a closed state of the lower tray 120 may be connected to a side surface of the tray case 121. Thus, an elastic member mounting part 121*b* for mounting the elastic member 131 may be further provided.

The tray body 123 may be formed of an elastically deformable flexible material. The tray body 123 is seated on the tray case 121. The tray body 123 includes a plane part 124 and the recessed part 125 is recessed from the plane part 124.

The plane part 124 has a plate shape with a predetermined thickness. Also, the plane part 124 may have a shape to correspond to that of a top surface of the tray case 121 so that the plane part 124 is received into the tray case 121. Also, the recessed part 125 may define a lower side of a shell 150 (see FIG. 6) that is a space in which an ice piece is made. The recessed part 125 may have a hemispherical shape. That is, the recessed part 125 may have a shape corresponding to that of a recessed part 113 of the upper tray 110. Thus, when the upper tray 110 and the lower tray 120 are closed, the shell 150 may provide a space having a globular or spherical shape.

The recessed part 125 may pass through the seat part 121*a* of the tray case 121 to protrude downward. Thus, the recessed part 125 may be deformed by being pushed by the ejecting unit 160 when the lower tray 120 is rotated. As a result, an ice piece within the recessed part 125 may be separated to the outside.

Also, a lower protrusion 125*a* protruding upward is disposed on a circumference of the recessed part 125. When the upper tray 110 and the lower tray 120 are closed, the lower protrusion 125*a* (see FIG. 8) may overlap with an upper protrusion 113*a* (see FIG. 8) of the upper tray 110 to reduce water leakage.

The tray cover 126 may be disposed above the tray body 123 to fix the tray body 123 to the tray case 121. A screw or rivet may be coupled to the tray cover 126. The screw or rivet successively passes through the tray cover 126, the tray body 123, and the tray case 121 so that the lower tray 120 is assembled.

A punched part 126*a* having a shape corresponding to that of an opened top surface of the recessed part 125 defined in the tray body 123 is defined in the tray cover 126. The punched part 126*a* may have a shape in which a plurality of circular shapes successively overlap with each other. Thus, when the lower tray 120 is completely assembled, the recessed part 125 is exposed through the punched part 126*a*, and the lower protrusion 125*a* is disposed inside the punched part 126*a*.

The upper tray 110 defines an upper appearance of the ice maker 100. The upper tray 110 may include a mounting part 111 for mounting the ice maker 100 and a tray part 112 for making ices.

In detail, the mounting part 111 is configured to mount the ice maker 100 inside the freezing compartment 4 or the case 101. The mounting part 111 may extend in a vertical direction perpendicular to that of the tray part 112. Thus, the mounting part 111 may surface-contact a side surface of the freezing compartment 4 or the case 101 to maintain a stably mounted state thereof.

Also, the tray part 112 may have a shape corresponding to that of the lower tray 120. The tray part 112 may include a plurality of recessed parts 113 recessed upward and having a hemispherical shape. The plurality of recessed parts 113 are successively arranged in a line. When the upper tray 110 and the lower tray 120 are closed, the recessed part 125 of the lower tray 120 and the recessed part 113 of the upper tray 110 are coupled to match each other in shape to form the shell 150, which provides an ice making space having a globular shape. Here, the recessed part 113 of the upper tray 110 may be formed of an elastic material, like the recessed part 125 of the lower tray 120, so that ice pieces are easily separated.

A shaft coupling part 111*a* to which the lower plate connection part 122 is shaft-coupled may be further disposed on a rear side (a left side in FIG. 14) of the tray part 112. The shaft coupling part 111*a* extends downward from both sides of a bottom surface of the tray part 112 and is shaft-coupled to the lower tray connection part 122. Thus, the lower tray 120 is shaft-coupled to the upper tray 110 and thus is rotatably mounted. That is, the lower tray 120 selectively contacts the upper tray 110 while being rotated by the driving unit 140. The lower tray 120 is attached to the upper tray 110 in a horizontal state. Also, the lower tray 120 is rotated downward at a predetermined angle until the lower tray 120 is compressed by the ejecting unit 160 to perform the ice separation operation.

The upper tray 110 may be formed of a metal material. Also, the upper tray 110 may be configured to quickly freeze water within the shell 150 through thermal conduction. Also, an ice separating heater 161 for heating the upper tray 110 to separate ice pieces from the upper tray 110 may be further disposed on a top surface of the upper tray 110. Also, a water supply unit 170 for supplying water into the upper tray 110 may be further disposed above the upper tray 110.

A rotating arm 130 and the elastic member 131 are connected to a side of the lower tray 120. The rotating arm 130 may be provided to provide tension of the elastic member 131. The rotating arm 130 may be rotatably mounted on the lower tray 120.

The rotating arm 130 has one end shaft-coupled to the lower tray connection part 122. Thus, even though the lower tray 120 is in a closed state, the rotating arm 130 may be further rotated to allow the elastic member 131 to extend. Also, both ends of the elastic member 131 are connected to the other end of the rotating arm 130 and the elastic member mounting part 121*b*, respectively. The elastic member 131 may include a tension spring. Thus, the rotating arm 130 may be further rotated in a counterclockwise direction as shown in FIG. 5 in a state where the lower tray 120 is in the closed state to allow the elastic member 131 to extend. Also, the lower tray 120 may be attached to the upper tray 110 by the elastic force of the elastic member 131 to reduce water from leaking during the making of ice.

For this, the rotation shaft 141 of the driving unit 140 may pass through a rotation shaft hole 132 of the rotating arm 130 and a rotation shaft hole 122*a* of the lower tray connection part 122. Also, the rotation shaft hole 132 of the rotating arm 130 may have a shape corresponding to that of the rotation shaft 141 of the driving unit 140. Thus, when the rotation shaft 141 of the driving unit 140 is rotated, the rotating arm 130 may be rotated also together with the rotation shaft 141. Also, the rotation shaft hole 122*a* of the lower tray connection part 122 may have a width greater than that of a rotation shaft rib 141*a* of the driving unit 140. Thus, even though the lower tray 120 is completely closed, the rotation shaft 141 of the driving unit 140 may be further rotated to rotate the rotating arm 130 in the counterclockwise direction. Thus, the lower tray 120 may be more closely attached to the upper tray 110 by a restoring force of the elastic member 131.

The driving unit 140 includes a driving motor. Also, the driving unit 140 is disposed on a side of the upper tray 110 and the lower tray 120. The driving unit 140 may include a deceleration gear assembly in which a plurality of gears are combined with each other to adjust a rotation amount and speed of the lower tray 120.

Hereinafter, the shell 150 defined by coupling the upper tray 110 to the lower tray 120 and structure of the upper and lower trays 110 and 120 relating to the shell 150 will be described in more detail.

Figure 6:
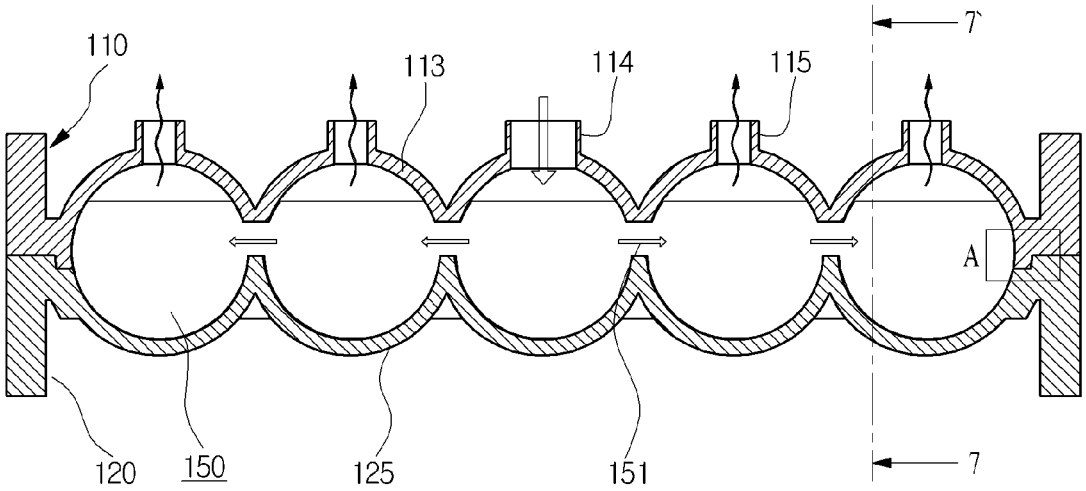
FIG. 6 is a longitudinal cross-sectional view of an upper tray and a lower tray.
Figure 7:
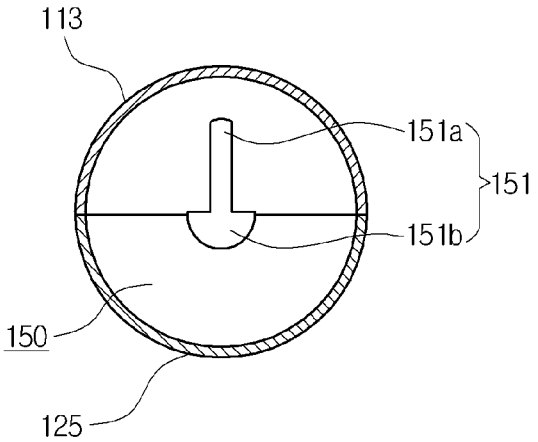
FIG. 7 is a cross-sectional view taken alone line 7-7' of FIG. 6.
Figure 8:
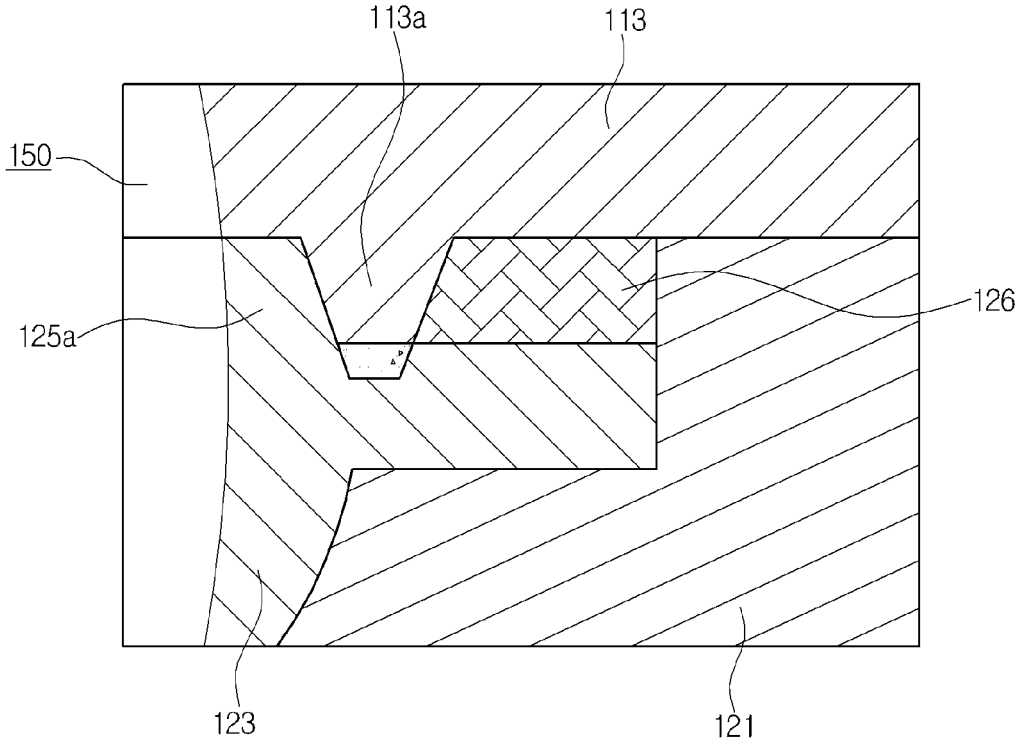
FIG. 8 is a partially cross-sectional view of a state in which the upper tray and the lower tray are closed, and is a partially enlarged view of a portion A of FIG. 6.

FIG. 6 illustrates a longitudinal cross-sectional view of an example upper tray and an example lower tray. FIG. 7 illustrates a cross-sectional view taken alone line 7-7' of FIG. 6. FIG. 8 illustrates a partial cross-sectional view of a state in which the upper tray and the lower tray are closed, and is a partially enlarged view of a portion A of FIG. 6.

Referring to FIGS. 6 to 8, a plurality of air holes 115 extend upward in the upper tray 110. The air holes 115 may be configured to exhaust air until water is supplied into the shell 150. Each of the air holes 115 passes through an upper end of each recessed part 113 defined in the upper tray 110. Also, the plurality of air holes 115 may serve as guide holes for guiding the access of an ejecting pin 162 (see FIG. 11) for separating made ice having the globular shape.

The water supply part 114 is disposed in the approximately central shell 150 of the plurality of shells 150. The water supply part 114 passes through the recessed part 113 of the upper tray 110. Also, the water supply part 114 may have a diameter greater than that of the air hole 115 to smoothly supply water into the shell 150. The water supply part 114 may be disposed in a left or right end of the plurality of shells 150 to conveniently supply water. The water supply part 114 may perform a function for guiding the access of the ejecting pin 162 for exhausting air and separating ices when water is supplied in addition to the water supply function.

The plurality of shells 150 are integrally connected to each other by a water path 151. Thus, water introduced by the water supply part 114 may be smoothly supplied into the plurality of shells 150. The water path 151 may be defined in a portion at which the plurality of shells 150 contact each other. The water path 151 may be constituted by an upper path 151*a* defined in the upper tray 110 and a lower path 151*b* defined in the lower tray 120. Also, when the upper tray 110 and the lower tray 120 are closed, the upper path 151*a* and the lower path 151*b* may contact each other to define one water path 151.

The lower path 151*b* may be defined in an upper end of the recessed part 125 of the lower tray 120. Here, the lower path 151*b* may be opened in a semicircular shape. Also, the upper path 151*a* may be defined in a lower end of the recessed part 113 of the upper tray 110. Here, the upper path 151*a* may be opened in a square shape. The upper path 151*a* may have a width less than and a length greater than those of the lower path 151*b*.

Water supplied through the water supply part 114 may be filled into each of the shells 150 via the water path 151. Here, the water passing through the water path 151 may have a speed of about 0.3 m/s. Also, the water may be quickly supplied into each of the shells 150, and simultaneously supplied without overflowing.

As shown in FIG. 8, the upper tray 110 and the lower tray 120 are closely attached to each other to block stored water from leaking. Also, the upper tray 110 and the lower tray 120 are closely attached to form a globular or spherical shape in an inner surface thereof, thereby generating a globular or spherical ice.

In detail, the tray body 123 seated on the tray case 121 may be formed of an elastic material. Also, the lower protrusion 125*a* may protrude upward. Also, the upper protrusion 113*a* may protrude downward from a circumference of the recessed part 113 of the upper tray 110. Here, the upper protrusion 113*a* may have a diameter greater than that of an opened surface of the recessed part 113. Also, the lower protrusion 125*a* may be received into the upper protrusion 113*a*. That is, the upper protrusion 113*a* may have an inner diameter corresponding to an outer diameter of the lower protrusion 125*a*.

The upper protrusion 113*a* and the lower protrusion 125*a* may be closely attached to each other in the state where the upper tray 110 and the lower tray 120 are closed with respect to each other. Also, the tray body 123 of the lower tray 120 contacting the upper tray 110 may be more closely attached to the upper tray 110 by the restoring force of the elastic member 131. Also, a space having a shape corresponding to a sectional shape of the upper protrusion 113*a* may be defined between the lower protrusion 125*a* and the tray cover 126 so that the upper protrusion 113*a* is inserted.

Thus, the plurality of shells 150 may be maintained in the state closely attached with respect to each other when the upper tray 110 and the lower tray 120 are closed. That is, the remaining portions except for the water path 151 may be closely attached by the upper protrusion 113*a* and the lower protrusion 125*a*. Also, the recessed part 113 of the upper tray 110 and the recessed part 125 of the lower tray 120 may be coupled to each other to form the shell 150 having a globular or spherical shape therein.

Figure 11:
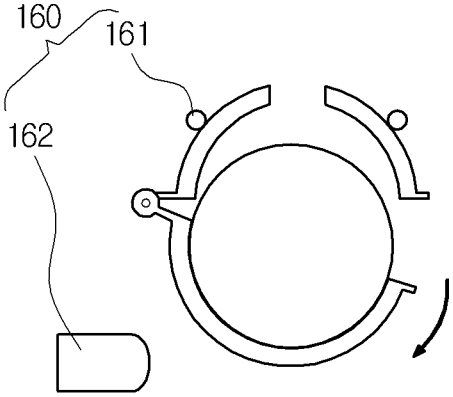
Figure 12:
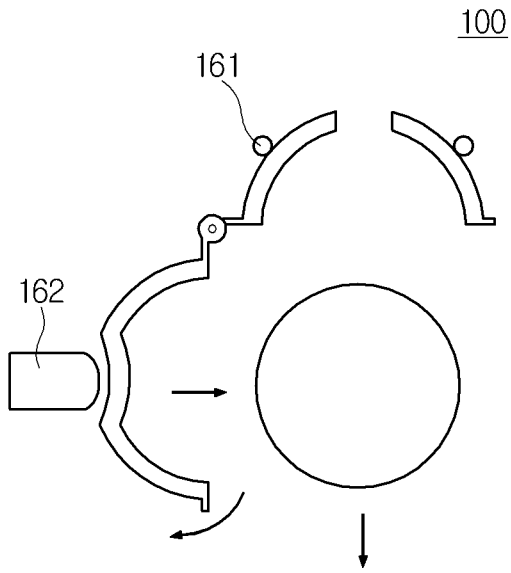

As shown in FIGS. 11 and 12, the ejecting unit 160 is disposed outside the upper tray 110 or the lower tray 120. The ejecting unit 160 may include an ice separating heater 161 and/or the ejecting pin 162. This structure will be described below in more detail.

FIGS. 9 to 12 show views successively illustrating an example operation of the ice tray from a water supply process to an ice separation process.

Figure 9:
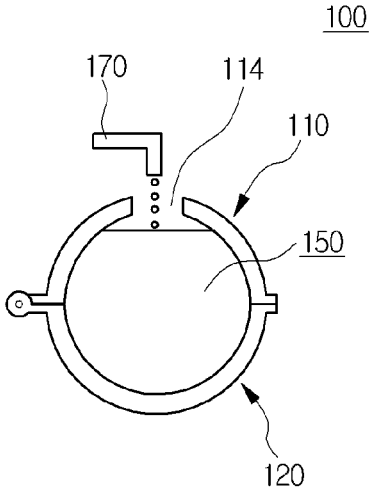
FIGS. 9 to 12 are views successively illustrating an operation of the ice tray from a water supply process to an ice separation process.

Referring to FIGS. 9 to 12, the ice maker 100 supplies water into the shell 150 through the water supply unit 170 in the state where the upper tray 110 and the lower tray 120 are closed as shown in FIG. 9. The supplied water is introduced into the shell 150 through the water supply part 114. After the water is introduced into one shell 150, the water is supplied into each of the shells 150 through the water path 151 to fill the water into the plurality of shells 150. Here, an amount of supplied water may be controlled using a flow amount sensor, a water level sensor, or a timer so that a fixed amount of water is supplied into the ice maker 100.

Figure 10:
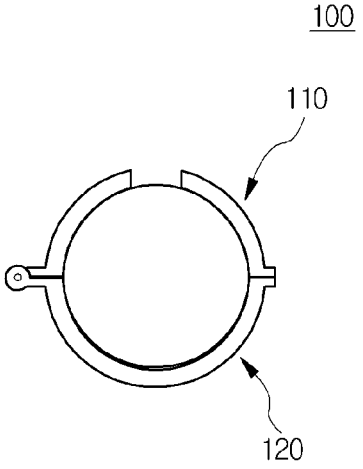

After the water is completely supplied into the plurality of shells 150, as shown in FIG. 10, cool air is supplied for a preset time to make ice pieces. Here, the upper tray 110 and the lower tray 120 are closely attached to each other by the elastic member 131 and the tray body 123 to maintain sealing therebetween, thereby reducing water leakage.

Here, a reason in which the globular or spherical ice as shown in FIG. 10 has a volume different from that corresponding to a water level of the supplied water as shown in FIG. 9 is because of the law of nature in which water is expanded in volume when the water is frozen. Thus, when water is supplied, an amount of water relatively less than a volume of the total shells should be supplied in consideration of the volume expansion of the water.

After ice pieces are made in the plurality of shells 150, the ice pieces are separated as shown in FIG. 11. In detail, after ice pieces are made, the ice separation heater 161 attached to the top surface of the upper tray 110 is operated. The ice separation heater 161 heats the upper tray 110 formed of the metal material to melt a portion of the globular or spherical ice piece contacting a surface of the upper tray 110. Thus, the globular ice piece may be separated from the recessed part 113 of the upper tray 110.

In this state, when the lower tray 120 is rotated in a clockwise direction as shown in FIG. 11, the made ice piece is separated from the upper tray 110, and then, is moved together with the lower tray 120 in a state where the ice is seated on the recessed part 125 of the lower tray 120.

In this state, the lower tray 120 is further rotated in the clockwise direction as shown in FIG. 12 to separate made ice pieces from the lower tray 120, thereby completely separating the ice pieces from the ice maker 100.

In detail, the ejecting pin 162 is disposed under the lower tray 120. The ejecting pin 162 laterally protrudes in a direction crossing the rotation direction of the lower tray 120. Thus, when the lower tray 120 is rotated in the clockwise direction, an end of the ejecting pin 162 contacts a central portion of the protruding recessed part 125 of the lower tray 120.

When the lower tray 120 is rotated at about 90° in the clockwise direction, the ejecting pin 162 pushes the outside of the central portion of the recessed part 125. Here, since the recessed part 125 of the lower tray 120 is formed of an elastic material, the recessed part 125 may be deformed by a protruding length of the ejecting pin 162. Based on the deformation, the made globular ice piece is separated from the lower tray 120 by the ejecting pin 162. When the lower tray 120 is rotated in a counterclockwise direction, the recessed part 125 is spaced from the ejecting pin 162, and then is restored again in its original shape.

The ice separated from the lower tray 120 may be stored in the ice bank 102 disposed under the ice maker 100. Also, a user may take a desired amount of ice pieces out of the ice bank 102 or dispense the ice from the dispenser 7.

When the globular ice is completely separated from the ice maker 100, the lower tray 120 is rotated again in the counterclockwise direction. Then, the upper tray 110 and the lower tray 120 are closed, and water is supplied again as shown in FIG. 9.

As the above-described processes are repeatedly performed, the ice maker may continuously make and store ice pieces.

In another example of an ice separation mechanism, both an upper tray and a lower tray may be rotated by a driving unit. Also, a made globular or spherical ice piece may be separated by ejecting pins disposed above and below thereof.

Thus, other components except for the driving unit and the ejecting pin may be the same as those of the ice maker described above. Thus, the same components will be indicated by the same reference numerals, and their above detailed description will be referenced, rather than repeated.

Figure 13:
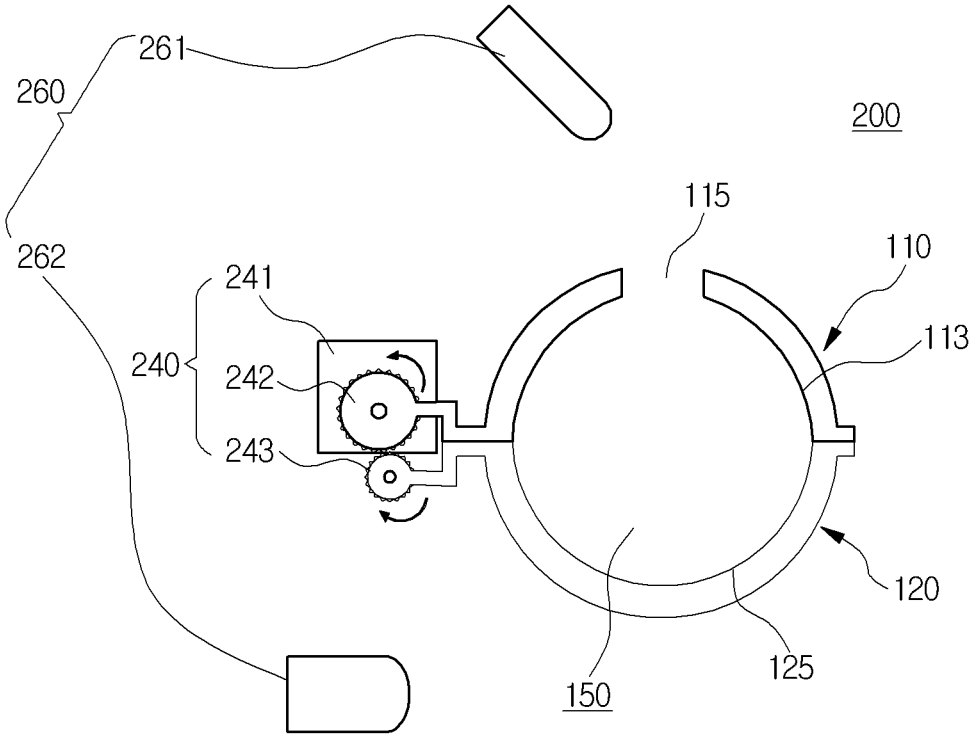
FIG. 13 is a schematic view of an ice maker including an ice separation mechanism.
Figure 14:
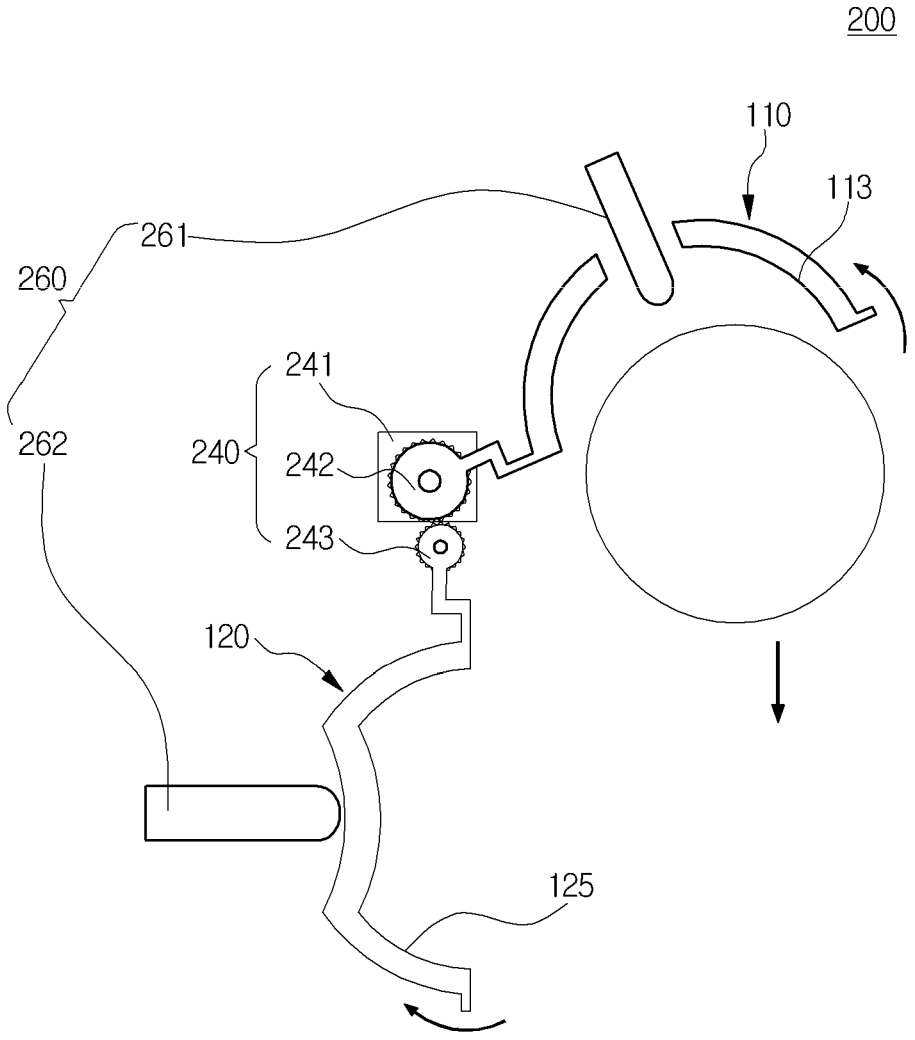
FIG. 14 is a view of a state in which an ice is separated from an upper tray.
Figure 15:
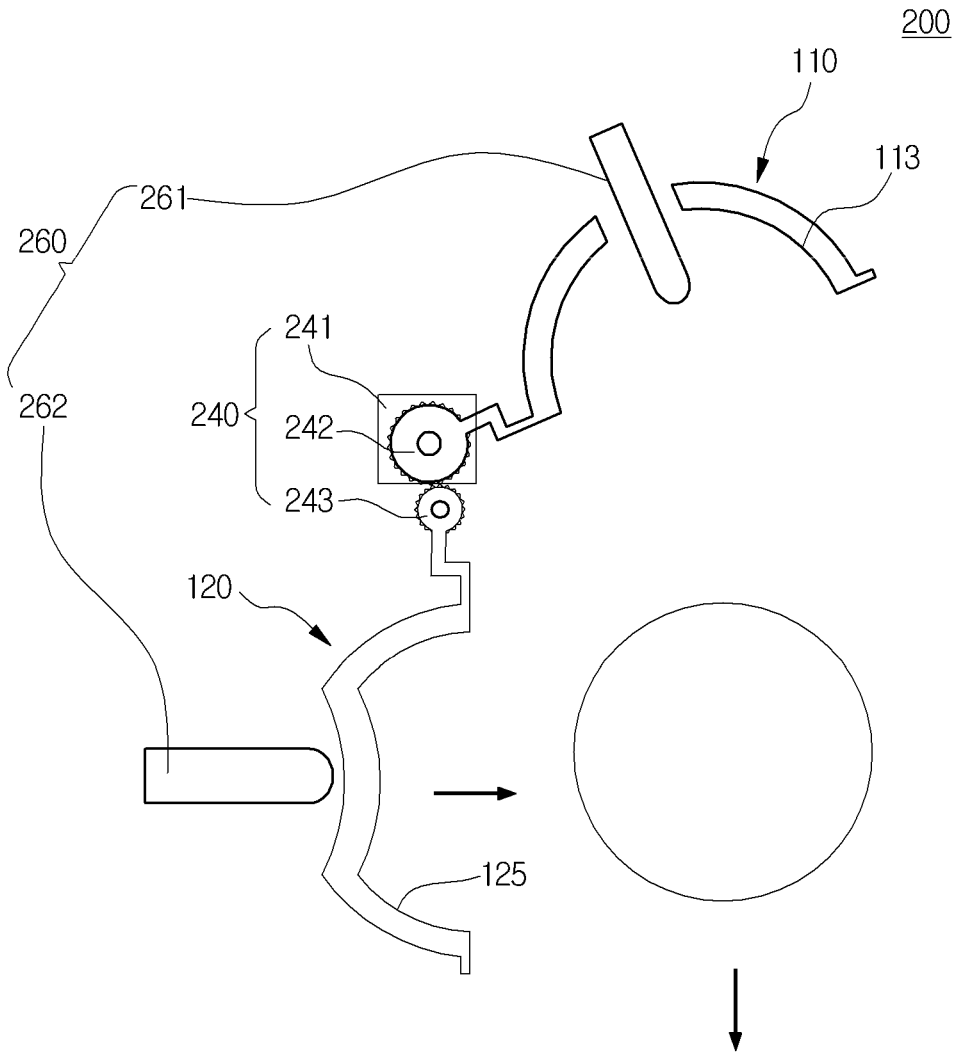
FIG. 15 is a view of a state in which an ice is separated from a lower tray.

FIG. 13 illustrates an example ice maker including an example ice separation mechanism. FIG. 14 illustrates a state in which an ice piece is separated from an upper tray. FIG. 15 illustrates a state in which an ice piece is separated from a lower tray.

Referring to FIGS. 13 to 15, an ice maker 200 including an ice separation mechanism includes an upper tray 110 and a lower tray 120 rotatably coupled to the upper tray 110 and formed of an elastically deformable material. The upper tray 110 may be formed of a metal material.

Recessed parts 113 and 125 disposed on the upper and lower trays 110 and 120 define a shell 150 that provides a space for making a globular or spherical ice piece when the upper and lower trays 110 and 120 are closed. Thus, when water supplied into the shell 150 is frozen, globular or spherical ice may be made.

An air hole 115 through which air within the shell 150 is exhausted may be defined in an upper portion of the upper tray 110. Also, the air hole 115 may have a size large enough to allow an upper ejecting pin 261 (that will be described in more detail below) to be accessible.

A gasket may be further disposed between the upper tray 110 and the lower tray 120. When the upper tray 110 and the lower tray 120 are closed, the gasket may seal a space between the upper tray 110 and the lower tray 120 to reduce leakage of the water within the shell 150 to the outside.

The ice maker 200 includes a driving unit 240 for operating the upper tray 110. The driving unit 240 includes a motor 241 for generating a rotation power, an upper plate gear 242 for rotating the upper tray 110, and a lower plate gear 243 for rotating the lower tray 120.

In detail, the motor 241 may be directly or indirectly connected to the upper plate gear 242 or the lower plate gear 243 to rotate the upper plate gear 242 or the lower plate gear 243. Also, the upper plate gear 242 is disposed on a rear end of the upper tray 110, and the lower plate gear 243 is disposed on a rear end of the lower tray 120. The upper plate gear 242 and the lower plate gear 243 are engaged with each other. When one of the upper plate gear 242 and the lower plate gear 243 is rotated, the other gear may be rotated together with the one gear to closely attach or separate the upper tray 110 and the lower tray 120 to or from each other.

The upper plate gear 242 has a diameter greater than or equal to that of the lower plate gear 243. As shown in FIGS. 13 to 15, if the lower plate gear 243 has a diameter less than that of the upper plate gear 243, the lower plate gear 243 may be rotated at a speed quicker than that of the upper plate gear 242. Thus, the lower tray 120 may have a rotation rate greater than that of the upper tray 110. With this design, the lower tray 120 has the rotation rate greater than that of the upper tray 110 and, therefore, an ice piece separated from the upper tray 110 drops directly into an ice storage part without dropping into or otherwise contacting the lower tray 120.

The ice maker 200 includes an ejecting unit 260 for separating an ice made in the shell 150. The ejecting unit 260 includes an upper ejecting pin 261 disposed above the upper tray 110 and a lower ejecting pin 262 disposed under the lower tray 120.

As shown in FIG. 14, when the upper tray 110 is rotated by about 45° in a counterclockwise direction, the upper ejecting pin 261 may pass through the air hole 115 to push the ice piece attached to the upper tray 110, thereby separating the ice piece from the upper tray 110.

Also, as shown in FIG. 15, when the lower tray 120 is rotated by about 90° in a clockwise direction, the lower ejecting pin 262 may push a central portion of the lower tray 120 to elastically deform the lower tray 120. Thus, an ice piece attached to the lower tray 120 is pushed by the deformation of the lower tray 120, and thus is separated from the lower tray 120.

According to yet another example, a globular or spherical ice piece made in a shell may be separated by an ejecting unit linked with a lower tray. Thus, other components except for the ejecting unit may be the same as those of the ice maker described above. Thus, the same components will be indicated by the same reference numerals, and their above detailed description will be referenced, rather than repeated.

Figure 16:
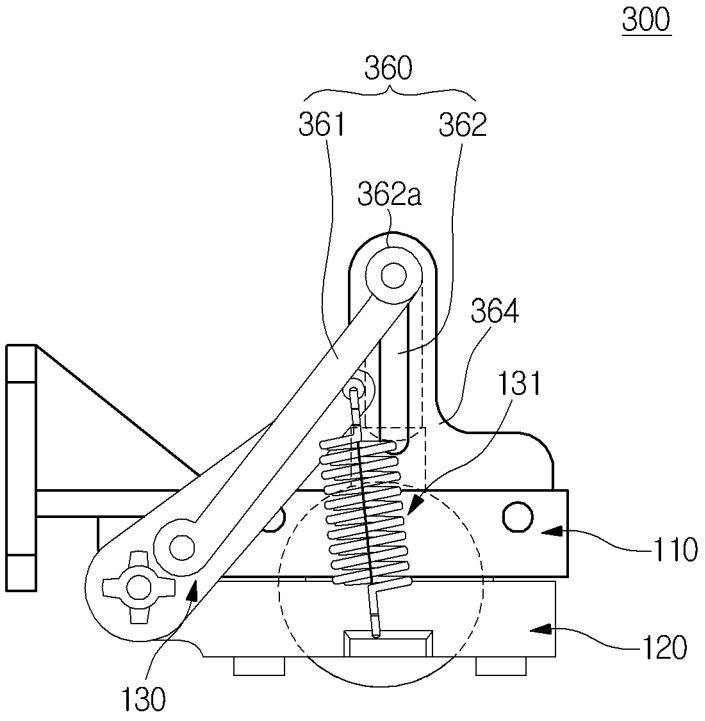
FIG. 16 is a side view of a state in which an ice maker is closed.
Figure 17:
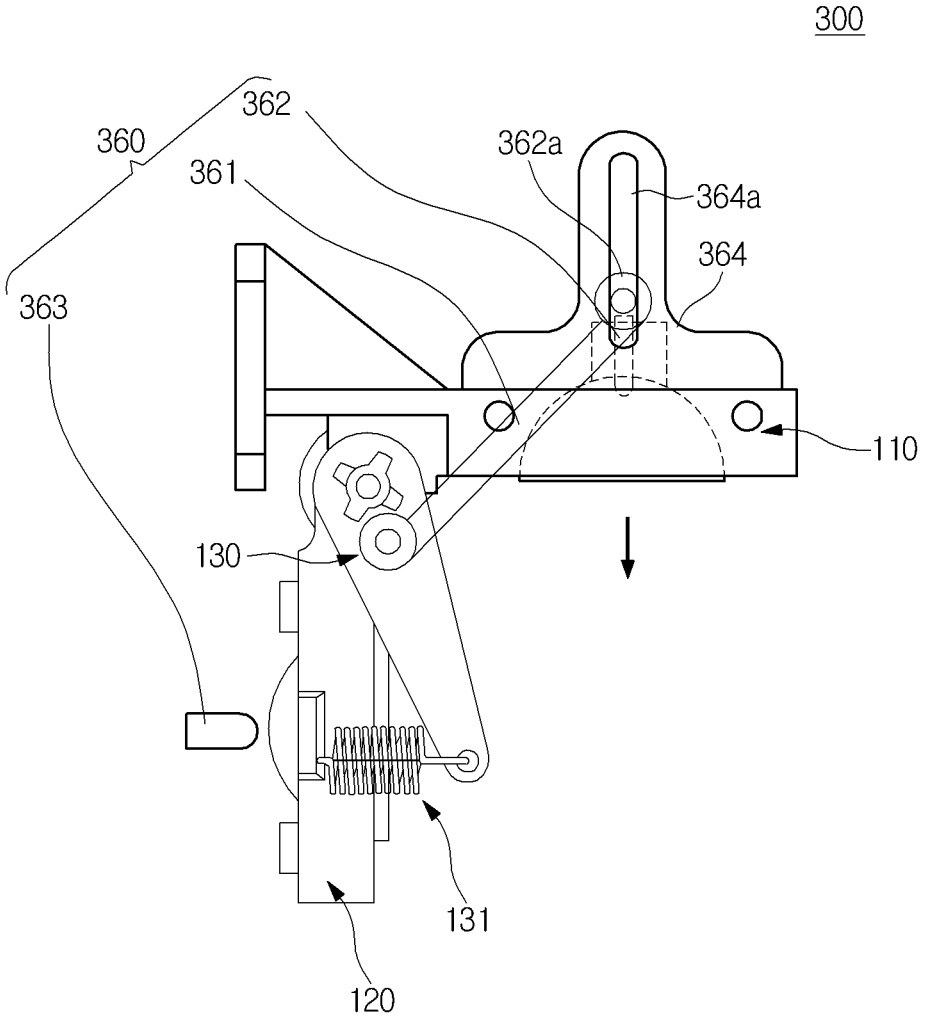
FIG. 17 is a side view of a state in which the ice maker is opened.

FIG. 16 illustrates a side view of a state in which an example ice maker is closed. FIG. 17 illustrates a side view of a state in which the example ice maker is opened. FIGS. 18 to 21 show views successively illustrating an ice separation process of the example ice maker.

Referring to FIGS. 16 to 21, an ice maker 300 includes an upper tray 110 formed of a metal material and a lower tray 120 of which at least a portion is formed of an elastic material. Also, the lower tray 120 is rotatably disposed on an upper tray 110. Further, the lower tray 120 is rotatably disposed by rotation of a driving unit (see reference numeral 140 of FIG. 3).

A rotating arm 130 and an elastic member 131 are disposed on the lower tray 120. In a state where the lower tray 120 is closed, the lower tray 120 may be closely attached to the upper tray 110 by an elastic force of the elastic member 131.

Also, the ice maker 300 includes an ejecting unit 360 for separating an ice piece made in a shell 150 defined by coupling the upper tray 110 and the lower tray 120 to each other. The ejecting unit 360 includes a link 361, an upper ejecting pin 362, and a lower ejecting pin 363.

In detail, the upper ejecting pin 362 is disposed above the upper tray 110. An upper ejecting pin 362 may be provided for each ice piece and the number of upper ejecting pins 362 may correspond to the number of shells 150. Thus, the plurality of upper ejecting pins 362 may extend from the bottom of a bar 362*a* that extends in a horizontal direction across a length of the upper tray 110. Also, the link 361 has one end connected to the bar 362*a* and the other end connected to the rotating arm 130. An ejecting pin guide 364 for guiding a vertical movement of the bar 362*a* is disposed above the upper tray 110. Also, a guide hole 364*a* vertically extends inside the ejecting pin guide 364. Thus, when the lower tray 120 is opened, an end of the link 361 connected to the bar 362*a* is vertically moved along the guide hole 364*a* by being linked with the rotation of the lower tray 120. Also, the upper ejecting pin 362 descends together with the bar 362*a* to push a globular ice piece made in a recessed part 113 of the upper tray 110, thereby separating the ice piece from the upper tray 110.

The lower ejecting pin 363 is disposed under the lower tray 120 and extends laterally. Thus, when the lower tray 120 is moved in a clockwise direction and thus completely opened, the lower ejecting pin 363 pushes a side of the lower tray 120 in which the made globular ice piece is received. Thus, the made ice piece within the lower tray 120 may be separated.

Figure 18:
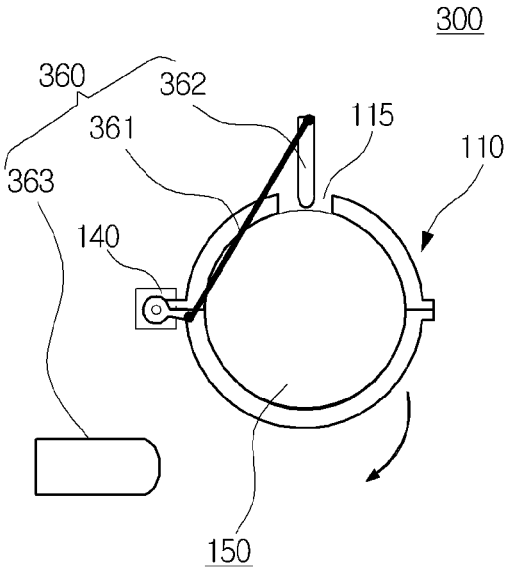
FIGS. 18 to 21 are views successively illustrating an ice separation process of the ice maker.

According to an operation of the ice maker 300 having the above-described structure, as shown in FIG. 18, water may be supplied in a state where the upper tray 110 and the lower tray 120 are closed. Thus, after a preset amount of water is filled into the shell 150, the ice making process may be performed.

Figure 19:
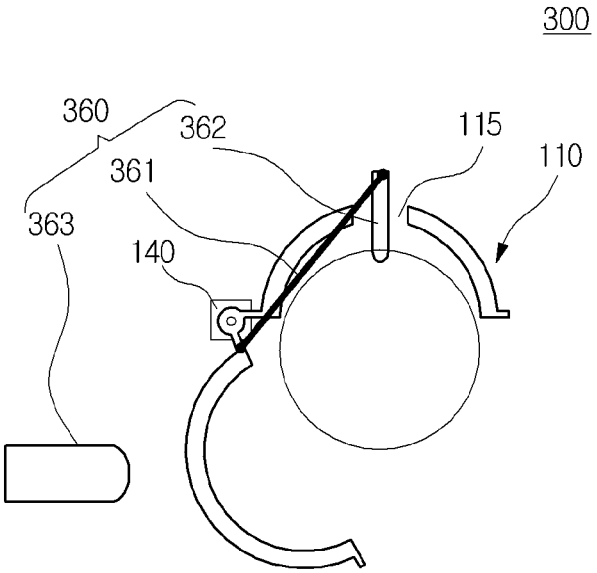

After the ice making process is finished, as shown in FIG. 19, the lower tray 120 is rotated in a counterclockwise direction by an operation of the driving unit 140. When the lower tray 120 is rotated, the rotating arm 130 may be rotated together with the lower tray 120. Also, the upper ejecting pin 362 is moved downward by the link 361. The downwardly moving upper ejecting pin 361 passes through an air hole 115 to push a globular or spherical ice piece made in the upper tray 110 downward.

Figure 20:
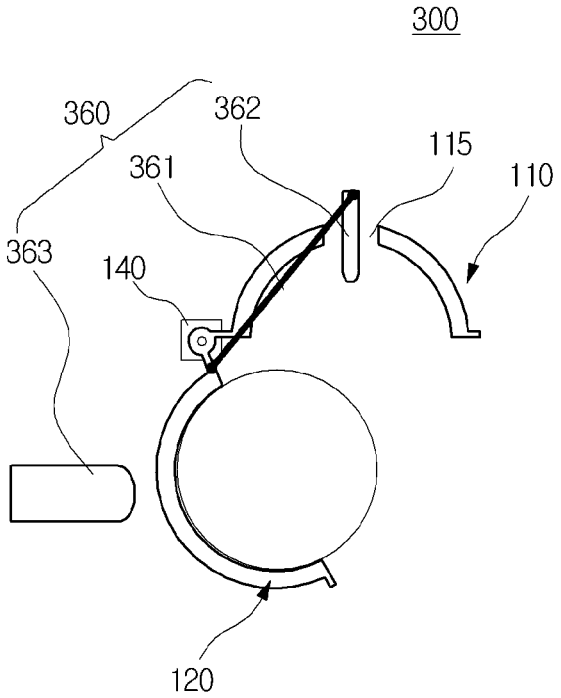

When the driving unit 140 is further rotated, as shown in FIG. 20, the lower tray 120 is further rotated in a clockwise direction, and the upper ejecting pin 362 is further moved downward so that the ice disposed on the upper tray 110 drops toward the lower tray 120.

Figure 21:
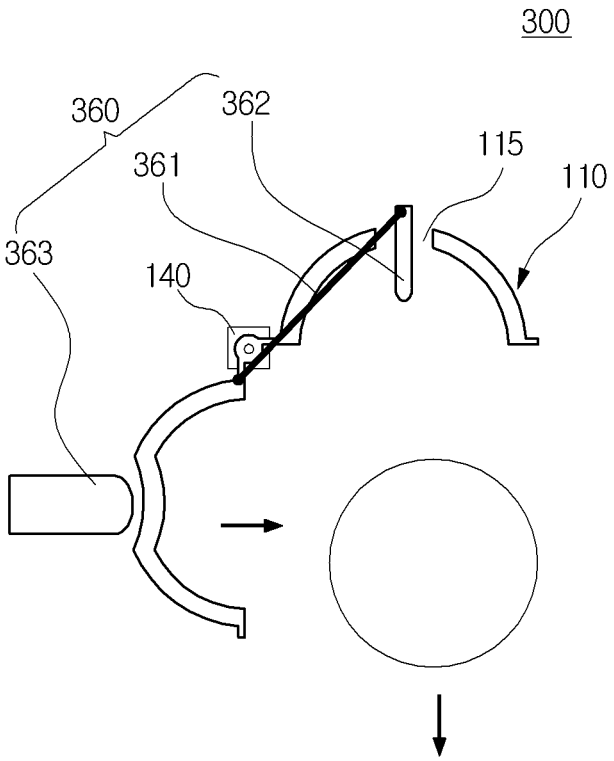

In a state where the made ice is seated on the lower tray 120, the lower tray 120 is further rotated by the driving unit 140. That is, as shown in FIG. 21, the lower tray 120 is rotated by about 90° in the clockwise direction. Here, a central portion of the lower tray 120 is pushed by the lower ejecting pin 363 and thus is deformed. Thus, the made globular ice piece may be separated from the lower tray 120 and then completely separated from the ice maker 300.

According to another example, a globular or spherical ice piece made in a shell may be separated by an ejecting unit linked with a lower tray. Also, when the ice is separated in this example, a heater heats an upper tray to assist the separation of the ice.

Thus, other components except for the ejecting unit may be the same as those of the ice maker described above. Thus, the same components will be indicated by the same reference numerals, and their above detailed description will be referenced, rather than repeated.

Figure 22:
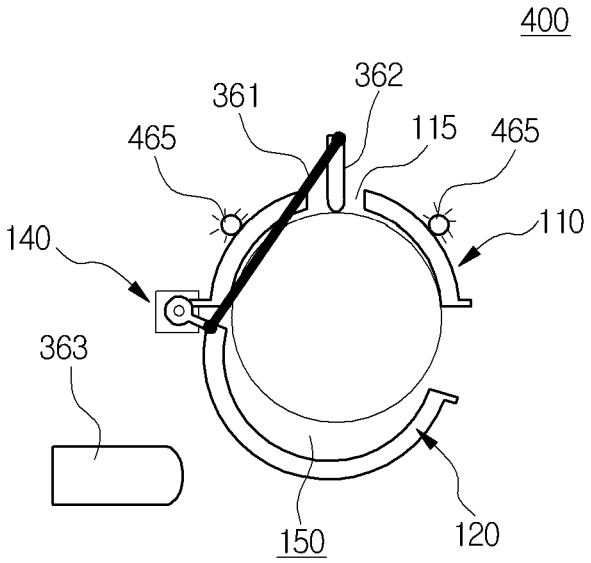
FIGS. 22 and 23 are views illustrating an ice separation process in an ice maker.
Figure 23:
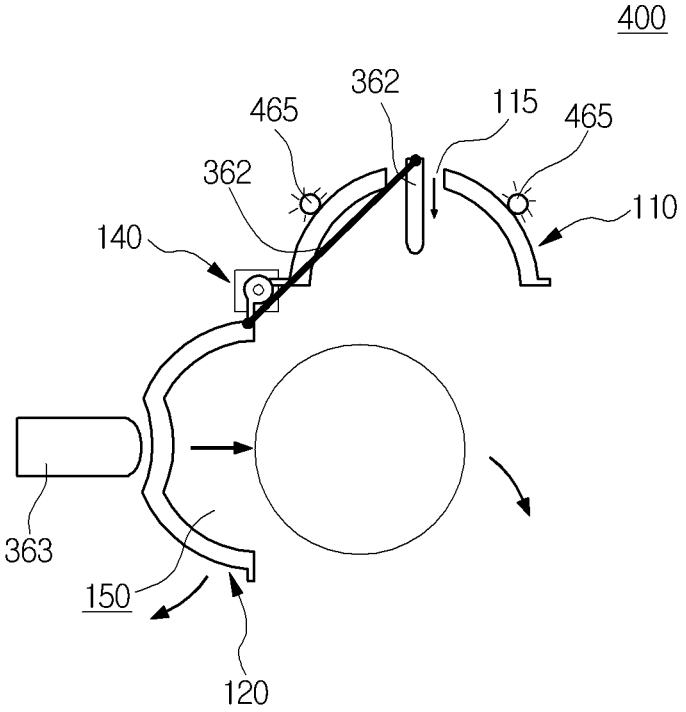

FIGS. 22 and 23 show views illustrating a separation process in an example ice maker.

Referring to FIGS. 22 and 23, an ice maker 400 includes an upper tray 110 formed of a metal material and a lower tray 120 of which at least a portion is formed of an elastic material. Also, like the example ice maker 300, an upper ejecting pin 362 is connected to a link 361. Thus, when the lower tray 120 is rotated, the upper ejecting pin 362 is linked with the lower tray 120 and moved downward.

Also, an ice separation heater 465 is disposed on the upper tray 110. The ice separation heater 465 may be operated when or just before the lower tray 120 is rotated. That is, the ice separation heater 465 heats the upper tray 110 to melt a surface of the ice contacting the upper tray 110. Thus, the upper ejecting pin 362 may more easily push the ice to separate the ice from the upper tray 110.

Also, a lower ejecting pin 363 extends laterally under the lower tray 120. When the lower tray 120 is rotated, the lower ejecting pin 363 may push the lower tray 120 to separate an ice piece disposed on the lower tray 120.

Hereinafter, a process for separating an ice piece by the ice maker 400 will be described.

First, in a state where an ice is completely made (e.g., frozen), a driving unit 140 is operated for separating the made ice. Before the driving unit 140 is operated or when the driving unit 140 is operated, the ice separation heater 465 may be operated. As the ice separation heater 465 is operated, the upper tray 110 is heated to melt a surface of the made ice contacting the upper tray 110. In a state where a portion of the surface of the made ice is melted, the driving unit 140 is operated, and thus, the lower tray 120 is rotated in a clockwise direction as shown in FIG. 22.

In this state, when the lower tray 120 is further rotated, the upper electing pin 362 is moved downward to pass through an air hole 115, thereby moving the ice disposed on the upper tray 110 downward.

The ice moved downward is seated on the lower tray 120. Then, the driving unit 140 is rotated to rotate the lower tray 120 by about 90° in a counterclockwise direction as shown in FIG. 23. When the lower tray 120 is rotated, the lower ejecting pin 363 pushes a central portion of the lower tray 120 to deform the lower tray 120. Thus, the ice seated on the lower tray 120 is separated from the lower tray 120, and thus is completely separated from the ice maker 400.

According to embodiment further example, an ice made in a shell is separated by an ejecting unit linked with a lower tray. In this example, when the ice is separated, a heater heats an upper tray and the lower tray to assist the separation of the ice.

Thus, other components except for the ejecting unit may be the same as those of the ice maker described above. Thus, the same components will be indicated by the same reference numerals, and their above detailed description will be referenced, rather than repeated.

Figure 24:
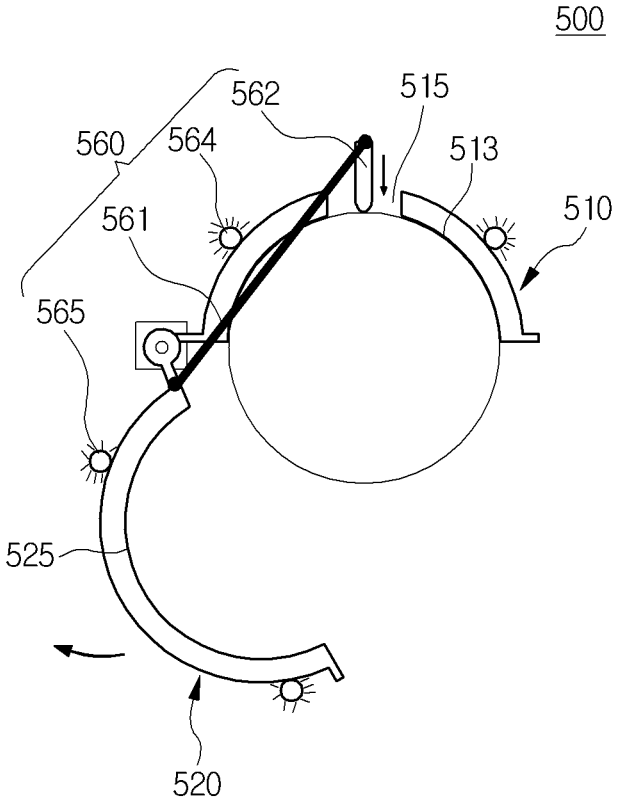
FIGS. 24 and 25 are views illustrating an ice separation process in an ice maker.
Figure 25:
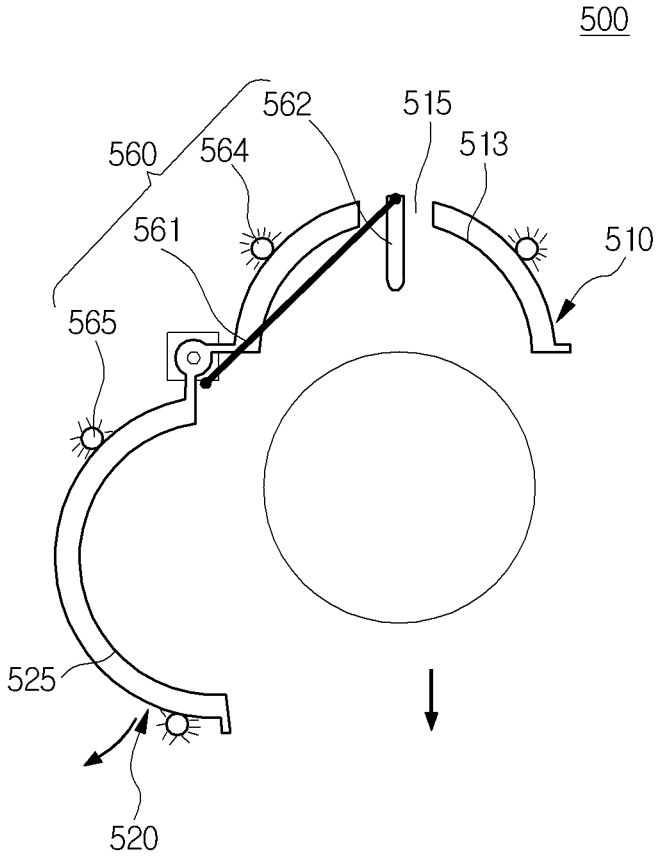

FIGS. 24 and 25 show views illustrating an example ice separation process in an example ice maker.

Referring to FIGS. 24 and 25, an ice maker 500 includes an upper tray 510 and a lower tray 520. Each of the upper tray 510 and the lower tray 520 is formed of a metal material to provide superior thermal conductivity. Thus, the ice making process and the ice separation process may be easily performed. Also, recessed parts 513 and 525 are respectively disposed on positions corresponding to the upper tray 510 and the lower tray 520. When the upper tray 510 and the lower tray 520 are closed, the recessed parts 513 and 525 contact each other to form a shell in which a globular or spherical ice piece is made.

Also, an ejecting unit 560 includes upper ejecting pins 562 respectively passing through air holes 515 of the upper tray 510 to push ice pieces, a bar (not shown) to which the plurality of upper ejecting pins 562 are connected, a link 561 having an end connected to the bar, and upper and lower ice separation heaters 564 and 565 respectively disposed on outer surfaces of the upper and lower trays 510 and 520.

In detail, the upper and lower ice separation heaters 564 and 565 may respectively heat the upper and lower trays 510 and 520 to melt a surface of each of the ice pieces contacting the upper tray 510. Thus, each of the upper ejecting pins 562 may push the ice to more easily separate the ice from the upper tray 510.

Hereinafter, a process for separating an ice by the ice maker 500 will be described.

First, in a state where an ice is completely made (e.g., frozen), the lower ice separation heater 565 is operated first to heat the lower tray 520, thereby separating the made ice from the lower tray 520. Thus, as the lower tray 520 is heated, a surface of a lower portion of an ice piece contacting the lower tray 520 is melted. After the lower ice separation heater 565 is operated for a preset time, when a driving unit is operated, the lower tray 520 is rotated in a clockwise direction. Here, since the made ice has a melted lower surface, the ice is separated from the lower tray 520 to become in a state of FIG. 24.

After the lower ice separation heater 565 is operated and a preset time elapses or when the rotation of the lower tray 520 starts, the upper ice separation heater 564 is operated. When the upper ice separation heater 564 is operated, the upper tray 510 is heated to melt a surface of an upper portion of an ice contacting the upper tray 510.

In this state, when the lower tray 520 is further rotated, an upper ejecting pin 562 is moved downward to move the ice disposed on the upper tray 510 downward as shown in FIG. 25. Here, since a surface of the ice disposed on the upper tray 510 has been melted, the upper ejecting pin 562 may pass through the air hole 515 to push the ice, thereby separating the ice from the ice maker 500.

In some implementations, an ejecting unit which does not include the ejecting pin 562 and the link 561 may be applied to the ice maker 500. That is, in the structure of the ice maker 500, an ejecting unit in which the upper ice separation heater 564 and the lower ice separation heater 565 are respectively mounted on a top surface of the upper tray 510 and a bottom surface of the lower tray 520 without including a separate ejecting pin may be applicable. According to the ice separation process in this structure, the lower ice separation heater 565 is operated first to separate a lower portion of the ice from the lower tray 520, and then, the lower tray 520 is rotated downward (in the clockwise direction in FIG. 25). Thus, the globular or spherical ice pieces may be maintained in a state where the ice is attached to the upper tray 510. In this state, the upper ice separation heater 564 may be operated to separate the ice from the upper tray 510. Then, the separated ice may drop directly into an ice storage container.

According to another example, upper and lower trays may be rotated by rotation of a driving unit and then moved in left and right directions to separate ice pieces disposed on both sides thereof by ejecting pins.

Figure 26:
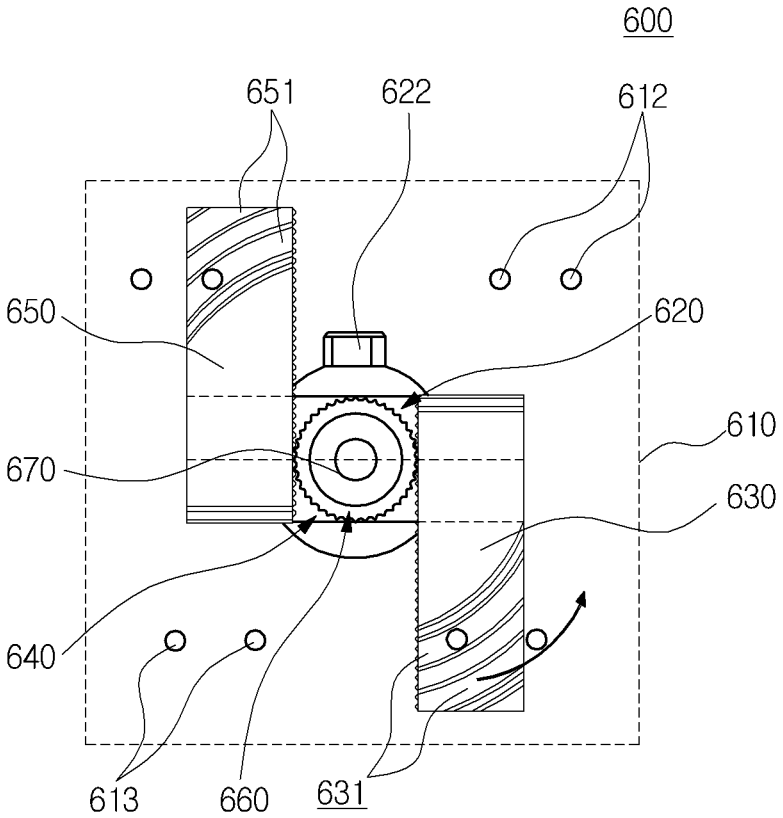
FIG. 26 is a side view of an ice maker.
Figure 27:
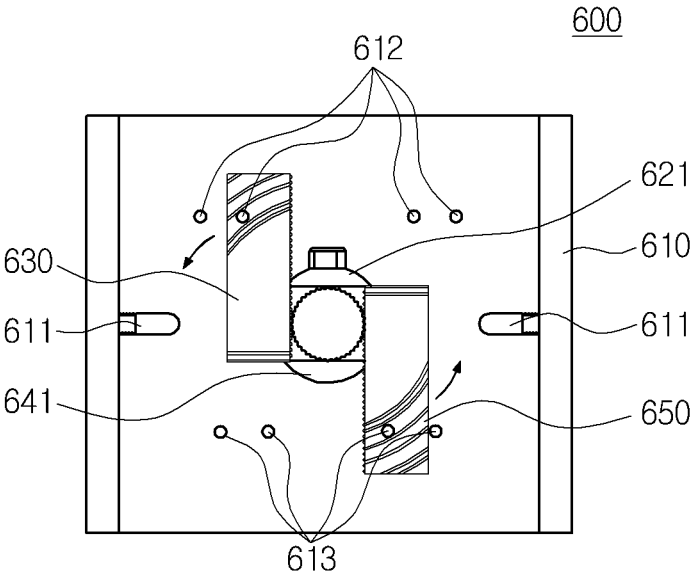
FIGS. 27 to 29 are views successively illustrating an operation of the ice maker.
Figure 28:
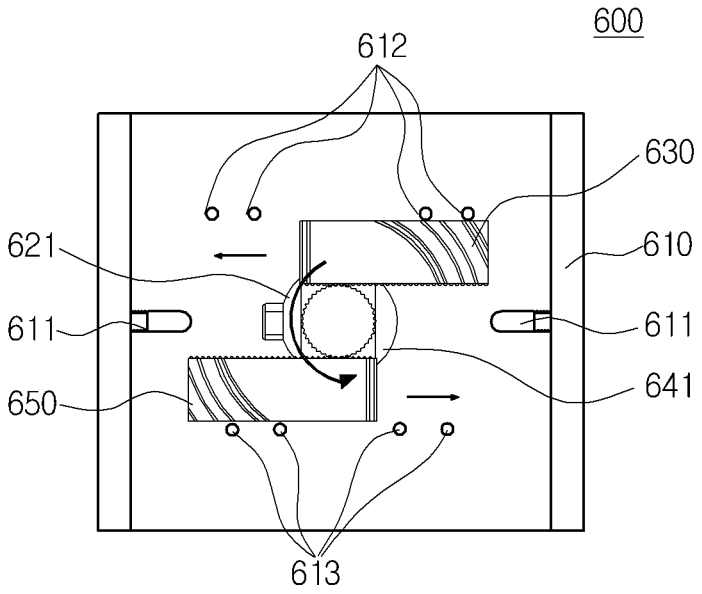
Figure 29:
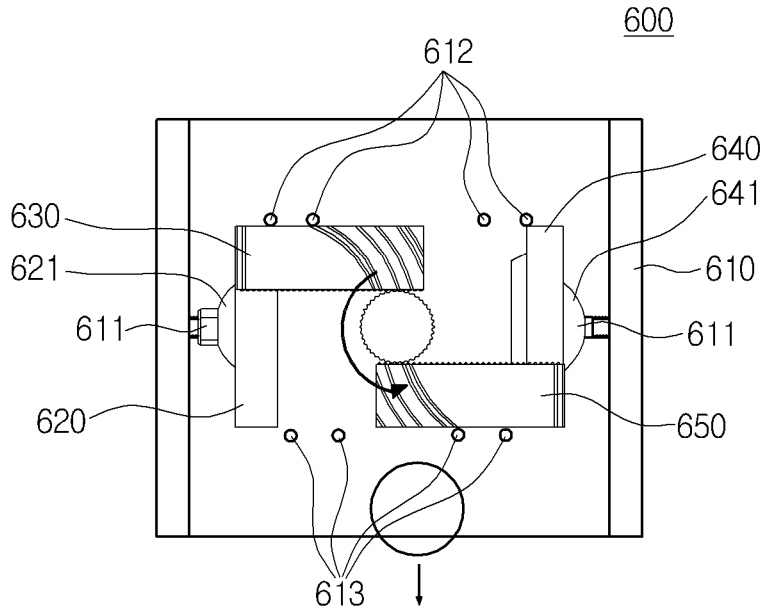

FIG. 26 illustrates a side view of an example ice maker. FIGS. 27 to 29 show views successively illustrating an operation of the example ice maker.

Referring to FIGS. 26 to 29, an ice maker 600 includes a case 610 defining an outer appearance thereof, upper and lower trays 620 and 640 disposed within the case 610, a driving unit 670 for operating the upper and lower trays 620 and 640, upper and lower racks 630 and 650 respectively connected to both sides of the upper and lower trays 620 and 640 to transmit a power of the driving unit 670, and ejecting pins 611 for separating made ice pieces.

In detail, the case 610 may receive the upper tray 620 and the lower tray 640. Also, the case 610 is mounted inside the freezing compartment (see reference numeral 4 of FIG. 1). The ejecting pin 611 horizontally extends from both side surfaces of the case 610 corresponding to front and rear surfaces of the trays 620 and 640. The ejecting pins 611 are respectively disposed at positions corresponding to a recessed part 621 of the upper tray 620 and a recessed part 641 of the lower tray 640, which will be described in more detail below. The ejecting pins 611 may have the same height and be disposed facing each other.

Also, upper and lower guide protrusions 612 and 613 are disposed on both side surfaces of the case 610 corresponding to both sides of the trays 620 and 640, respectively. The upper guide protrusions 612 are disposed on an upper portion of the case 610, and the lower guide protrusions 613 are disposed on a lower portion of the case 610.

Also, a plurality of upper and lower guide grooves 631 and 651, each having a predetermined curvature, are defined in upper and lower racks 630 and 650, respectively.

A plurality of recessed parts 621 are successively arranged in a line in the upper tray 620. At least the recessed part 621 of the upper tray 620 may be formed of an elastically deformable material.

The upper rack 630 extends downward from both side surfaces of the upper tray 620. Also, the upper rack 630 is engaged with a pinion 660 that will be described in more detail below. The pinion 660 is connected to a rotation shaft of the driving unit 670. Also, when the upper tray 620 is rotated by about 90° in a counterclockwise direction, the upper rack 630 is restricted by the upper guide protrusion 612 and thus is not rotated.

Also, the lower tray 640 is disposed under the upper tray 620. A plurality of recessed parts 641 are successively arranged in a line in the lower tray 640. The lower tray 640 may be coupled to the upper tray 620 and closed. In a state where the upper tray 620 and the lower tray 640 are closed, each of the recessed parts 641 defines a shell that provides a space for making a globular or spherical ice piece.

At least the recessed part 641 of the lower tray 640 is formed of an elastically deformable material. Also, the lower rack 650 is disposed on each of both side surfaces of the lower tray 640. The lower rack 650 extends downward from each of both side surfaces of the lower tray 640. Also, the lower rack 650 is engaged with the pinion 660. When the lower tray 640 is rotated by about 90° in a counterclockwise direction, the lower rack 650 is restricted by the lower guide protrusion 613 and thus is not rotated.

A water supply part, an air hole, and a water path may be provided in each of the upper and lower trays 620 and 640, as described in the examples explained above.

The driving unit 670 may be provided to a side of the upper and lower trays 620 and 640. The pinion 660 is mounted on a rotation center of the driving unit 670. The pinion 660 may have the same rotation center as those of the upper and lower trays 620 and 640. The upper rack 630 and the lower rack 650 are gear-coupled to each other. Thus, when the pinion 660 is rotated, the upper rack 630 and the lower rack 650 may be moved with respect to each other.

Hereinafter, an operation of the ice maker 600 will be described.

First, as shown in FIG. 26, the upper and lower trays 620 and 640 are coupled to each other so that water is supplied into a shell for making an ice piece. In this state, water for making an ice piece is supplied through a water supply part 622. After the water is filled into the shell, a cooling process is performed for a preset time to form an ice piece.

When the globular or spherical ice piece is completely made in the shell (e.g., frozen), the driving unit 670 is operated. In detail, when the driving unit 670 is rotated, the pinion 660 is rotated together with the driving unit 670. Thus, the upper and lower racks 630 and 650 which are engaged with the pinion 660 are rotated also. Here, the lower guide protrusion 613 is moved along the upper guide groove 631 defined in the upper rack 630, and substantially, the upper rack 630 is rotated. Similarly, since the upper guide protrusion 612 is moved along the lower guide groove 651, the lower rack 650 is rotated also. Each of the guide grooves 631 and 651 may have a length enough to separate the guide protrusions 612 and 613 from the guide grooves 631 and 651 when the upper and lower racks 630 and 650 are rotated by about 90°. The upper and lower racks 630 and 650 are stopped at positions, at which each of the upper and lower racks 630 and 650 is rotated by about 90°, by the guide protrusions 613 and 612 disposed on sides opposite to those of the guide protrusions 612 and 613 moving along the guide grooves 631 and 651 respectively defined in the racks 630 and 650.

In this state, when the driving unit 670 is further operated, the pinion 660 is further rotated also. Since the upper and lower rocks 630 and 650 are stopped by the guide protrusions 613 and 612 disposed on the sides opposite to those of the guide protrusions 612 and 613 moving along the guide grooves 631 and 651 respectively defined in the racks 630 and 650, the upper and lower racks 630 and 650 are linearly moved. That is, in the drawings, the upper rack 630 is moved in a left direction, and the lower rack 650 is moved in a right direction. As a result, the upper tray 620 integrally coupled to the upper rack 630 also may be moved in the left direction. The lower tray 620 integrally coupled to the lower rack 650 also may be moved in the right direction.

When the pinion 660 is further rotated, the upper and lower trays 620 and 640 are separated from each other, and then are moved in the left and right directions, respectively. When the upper and lower trays 620 and 640 are completely moved in the left and right directions as shown in FIG. 29, the recessed parts 621 and 641 of the upper and lower trays 620 and 640 are pushed by the ejecting pins 611 disposed on both sides of the case 610. Accordingly, the recessed parts 621 and 641 are pushed and deformed, and thus the ice pieces disposed in the recessed parts 621 and 641 are pushed to drop down.

In this process, after the ice pieces are completely separated from the ice maker 600, the driving unit 670 is reversely rotated. Also, the upper and lower trays 620 and 640 are moved in a reverse order of the above-described order, and then return to a standby state for receiving water.

According to the described examples, ice pieces are made in the plurality of shells which provide globular or spherical spaces, respectively. Thus, globular or spherical ice pieces may be made to minimize a contact area between the ice pieces when the ice pieces are stored, thereby reducing the ice pieces from being matted or stuck with respect to each other.

Also, the water supply part for supplying water may be disposed on the upper tray, and the air hole for exhausting air may be defined in the upper tray corresponding to each of shells. Thus, water may be smoothly supplied and filled into the shells. Also, the shells may communicate with each other by the water path. Thus, water may be smoothly supplied into the shells by the water path.

Also, the ejecting units for separating ice pieces made in the shells may be disposed outside the upper tray and the lower tray. Thus, the made ice pieces may be easily separated, thereby enabling a continuous ice making process.

Although implementations have been described with reference to a number of illustrative examples thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses also are apparent to those skilled in the art.

What is claimed is:

1. An ice maker comprising:

an upper tray comprising a plurality of first recessed parts, each of the first recessed parts having a hemispherical shape;

a lower tray rotatably coupled to the upper tray and comprising a plurality of second recessed parts, each of the second recessed parts having a hemispherical shape;

a driving unit that is connected to the lower tray and that is configured to rotate the lower tray to change between an attached orientation in which the first recessed parts of the upper tray are attached to the second recessed parts of the lower tray to define a plurality of spherical shells and a separated orientation in which the first recessed parts of the upper tray are separated from the second recessed parts of the lower tray;

a water supply part configured to supply water into the shells defined in the attached orientation; and an ejecting unit that is disposed outside of the shells and that is configured to facilitate separation of ice pieces made in the shells from at least one of the upper tray and the lower tray, wherein a top surface of at least one of the first recessed parts has an air hole configured to exhaust air existing within the shells during supply of water to the shells, wherein a top surface of at least one of the first recessed parts has a water hole that is different from the air hole, wherein an outlet end of the water supply part is disposed adjacent to the water hole and configured to supply water into the shells through the water hole, wherein the ice maker further comprises:

at least one lower protrusion that upwardly protrudes from a top surface of the lower tray along an edge of an open surface of each of the second recessed parts;

at least one upper protrusion that downwardly protrudes from a bottom surface of the upper tray along an edge of an open surface of each of the first recessed parts, and wherein, in the attached orientation, an outer surface of the at least one lower protrusion attaches to an inner surface of the at least one upper protrusion.

2. The ice maker according to claim 1, further comprising a water path configured to guide water flow between the shells adjacent to each other, wherein the water path comprises:

an upper path defined in the first recessed parts; and a lower path defined in the second recessed parts, wherein the upper path and the lower path contact and communicate with each other in the attached orientation.

3. The ice maker according to claim 1, wherein the ejecting unit comprises:

an ice separation heater mounted on the upper tray; and an ejecting pin configured to press the second recessed parts in the separation orientation.

4. The ice maker according to claim 1, further comprising:

a rotating arm having a first end connected to a rotation shaft of the lower tray; and an elastic member having a first end connected to a second end of the rotating arm and a second end connected to the lower tray, the elastic member providing an elastic force to secure the lower tray and the upper tray in the attached orientation, wherein the driving unit comprises a motor connected to the rotation shaft of the lower tray.

5. The ice maker according to claim 1, further comprising a gasket disposed between contact portions of the upper tray and the lower tray.

6. The ice maker according to claim 1, wherein the lower tray comprises:

a tray case coupled to the driving unit, the tray case having a plurality of holes successively arranged therein;

a tray body seated on the tray case, the tray body having the plurality of second recessed parts;

a tray cover seated on the tray body, the tray cover fixing the tray body to the tray case.

7. The ice maker according to claim 1, wherein at least a portion of at least one of the second recessed parts is made of a deformable flexible material.

* * * * *